US009427626B2

(12) United States Patent
Ben-Arie

(10) Patent No.: US 9,427,626 B2
(45) Date of Patent: Aug. 30, 2016

(54) SWIMMING DEVICE WITH RETRACTABLE FINS

(71) Applicant: Jezekiel Ben-Arie, Chicago, IL (US)

(72) Inventor: Jezekiel Ben-Arie, Chicago, IL (US)

( * ) Notice: Subject to any disclaimer, the term of this patent is extended or adjusted under 35 U.S.C. 154(b) by 0 days.

(21) Appl. No.: 14/816,043

(22) Filed: Aug. 2, 2015

(65) Prior Publication Data

US 2016/0030810 A1 Feb. 4, 2016

Related U.S. Application Data

(60) Provisional application No. 62/032,576, filed on Aug. 3, 2014, provisional application No. 62/036,597, filed on Aug. 12, 2014.

(51) Int. Cl.
*A63B 31/11* (2006.01)

(52) U.S. Cl.
CPC ..... *A63B 31/11* (2013.01); *A63B 2031/112* (2013.01); *A63B 2031/117* (2013.01)

(58) Field of Classification Search
CPC ..... A63B 2031/112
See application file for complete search history.

(56) References Cited

U.S. PATENT DOCUMENTS

| | | | | |
|---|---|---|---|---|
| 2,903,719 | A | 9/1959 | Wozencraft | |
| 3,268,927 | A * | 8/1966 | Markowitz | A63B 31/12 36/114 |
| 3,315,286 | A | 4/1967 | Brion | |
| 5,108,327 | A | 4/1992 | Klein | |
| 5,593,333 | A | 1/1997 | Johnson | |
| 5,924,902 | A | 7/1999 | Burns | |
| 6,155,898 | A | 12/2000 | Burns | |
| 6,672,920 | B2 | 1/2004 | Wilson | |
| D561,862 | S | 2/2008 | Moyal | |
| 8,678,870 | B2 | 3/2014 | Johnson | |

* cited by examiner

*Primary Examiner* — Edwin Swinehart

(57) ABSTRACT

The Swimming Device with Retracted Fins (SDRF) which enables swimming and walking. The SDRF employs Fins that have slanted axes of rotation which are connected to the heels of user's shoes. Fins are also tilted diagonally in opposite directions away from each other to prevent mutual Fin collisions while swimming or walking. Slanted fin shafts poses the Fins diagonally, leaning backwards while in walking position and leaning forwards while in swimming position. Backwards leaning prevents fin collisions with the calves while walking. Forwards leaning poses the fins in streamlined position with less drag during swimming. The SDRF has a positioning mechanism which enables easy changing of locked Fin positions. The SDRF is also equipped with a latching mechanism which enables detaching the Fins from the shoes simply by pulling at the latch. The latching mechanism also offers easy reattachment by pushing the Fin towards the swimming shoe.

18 Claims, 14 Drawing Sheets

2H
2A
2B
8B
6E
6A
ANGLE 5
3B
1D3
6B
1D1
1D2
ANGLE 2
3C1
3A
6A
2C
3C2
A
A
1E
1E
1A
2A
2K 1A
3C1
3A
2C
3D
4C
6B
6A
3B
8B
3D
3C2
1D2
5A
2C
1A
2E,6A
1E
2H
ANGLE 1
2D
1C
2B
3A
2E,6A
2F
4A
2K
2J

ANGLE 1
ANGLE 2
ANGLE 3
ANGLE 4
B
B
1A
1C
1D
1D1
1D2
1D3
1E
2A
2B
2C
2D
2E, 6A
2F
2H
2J
2K
3A
3B
3C1
3C2
3D
4A
4C
5A
6A
6E
8A
8B

FIG. 14
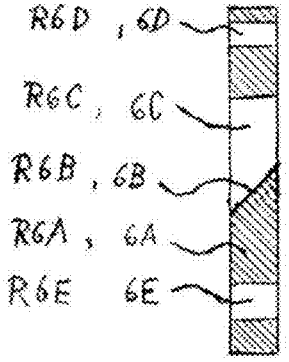
FIG. 13
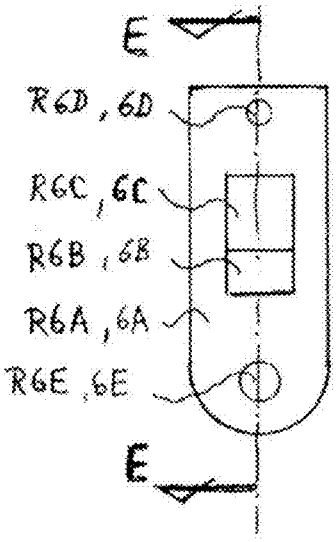
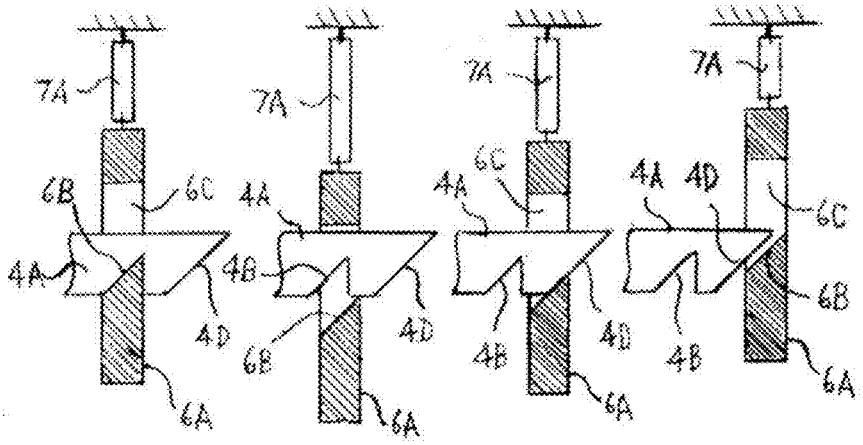
FIG. 18 FIG. 17 FIG. 16 FIG. 15

SWIMMING DEVICE WITH RETRACTABLE FINS

CROSS-REFERENCE TO RELATED APPLICATIONS

This application claims the benefit of a provisional patent application:

Ser. No. 62/032,576 filed on Aug. 3, 2014

Ser. No. 62/036,597 filed on Aug. 12, 2014

FEDERALLY SPONSORED RESEARCH

Not Applicable

SEQUENCE LISTING OR PROGRAM

Not Applicable

BACKGROUND OF THE INVENTION

1. Field of the Invention

The invention is in the area of Swimming Devices.

2. Description of Related Art

Currently, prevalent Swimming Devices include a set of two Fins made of resilient material which have foot pockets or shoes as means of wearing them on the user's feet. The conventional swimming Fins currently in wide use are not suited for walking and are not ideal for swimming. It is almost impossible to walk freely with the Fins worn on the feet without stumbling. Thus, swimmers have to walk without them on the beach and to wear them near the water line. When in shallow water, swimmers have still to continue walking hitting underwater rocks and stumbling. Fins have large planar sections which are used to push the water in order to propel the swimmer. Since the orientation of the planar sections is approximately parallel to the soles of feet when fins are worn, the conventional fins create a substantial drag while swimming because the orientation of the feet soles and of the planar sections during swimming is not parallel to the water flow. In addition, the wide planar sections of the fins are mutually colliding while swimming. In order to prevent Fins' mutual collisions, the swimmers need to keep the legs wide apart, which is inconvenient posture both in swimming and in walking.

Several inventions attempted to solve the problem of walking while wearing fins, most of them proposed similar arrangements of retracting fins by turning them upwards in front or behind the calves. Each fin is pivoted on two hinges installed on the left and right sides of the foot and can be turned upwards for walking. When the fins are leveled in front of the feet they can be used for swimming. Such are the inventions of U.S. Pat. No. 5,108,327 to Klein, U.S. Pat. No. D561,862 of Moyal, U.S. Pat. No. 6,672,920 B2 to Wilson, U.S. Pat. No. 3,315,286 to Brion, and U.S. Pat. No. 3,268,927 to Makowitz. Other inventions propose other retracting solutions such as in U.S. Pat. No. 5,924,902 and U.S. Pat. No. 6,155,898 to Burns et al. which proposed a small retractable fin up front as an extension of the sole, or U.S. Pat. No. 8,678,870 B2 to Johnson, which propose a very complex structure worn on the feet and calves to carry the fins. Other inventions involve flexible folding in U.S. Pat. No. 2,903,719 to Wozencraft et al. or in U.S. Pat. No. 5,593,333 to Johnson which folds part of the fin under the foot. However, all the inventions mentioned above do not eliminate the problems of mutual Fins' collisions and of substantial drag while swimming.

BRIEF DESCRIPTION OF THE INVENTION

The conventional swimming Fins currently in wide use, are not suited for walking and are not ideal for swimming. It is almost impossible to walk freely with the Fins worn on the feet without stumbling because Fins tend to collide with the ground and with one another. Since the Fins have wide planar sections with orientations which are approximately parallel to the soles of the swimmer's feet, they exhibit a significant drag in the water because the orientation of the feet's soles during swimming is not parallel to the direction of water flow. Our Swimming Device with Retractable Fins (SDRF) offers satisfactory solutions to these problems. First, the SDRF enables unhindered walking when retracted. Second, the SDRF has much less drag in the water since the wide sections of the retractable Fins are substantially parallel to the water flow during swimming. Third, changing SDRF positions from walking to swimming or vice versa is quick and can be performed easily on land or in water. Fourth, SDRFs can be easily detached from the swimming shoes or reattached to the swimming shoes.

The SDRF was designed entirely differently from all the other devices with retractable Fins in order to achieve all these advantages which require adjusting the fins in diagonal orientations which are not possible with the conventional approaches. In the SDRF structure, the Fins have slanted axes of rotation which are connected to the rear sides of user's swimming shoes. This arrangement enables to rotate (i.e. tilt) and lock the Fins diagonally in opposite directions away from each other both in swimming and in walking positions. The space created by the tilting prevents mutual Fin collisions while swimming and also during walking. In addition, the Fins' axes of rotation are also slightly slanted with respect to the horizontal direction of the user's soles. Slanting poses the Fins diagonally, leaning backwards with respect to the calves while in the walking position and leaning forwards while in the swimming position. Slanting has two advantages. The diagonal backwards leaning prevents Fin collisions with the calves while walking. The forwards leaning poses the Fins in more streamlined position with respect to the water flow, which results with less drag during swimming. The SDRF has a positioning mechanism which enables the user to easily change locked Fin positions simply by pulling the positioning members and rotating the Fins. The SDRF is also equipped with latching mechanisms which enable easy detaching of the Fins from the shoes simply by pulling at the latches. The latching mechanisms also allow quick reattachment of the Fins to the rear side of the swimming shoes simply by mounting and pushing the Fins towards the shoes.

BRIEF DESCRIPTION OF THE DRAWINGS

An embodiment of the SDRF is presented in FIGS. 1-23. However, this embodiment represents only one variation derived from the Swimming Device with Retractable Fins (SDRF) invention.

FIG. 13 is a front view of the latch and

FIG. 14 is a cross section side view of the latch in FIG. 13.

FIGS. 15-18 describe step by step the action of the latching mechanism by which the Fin is fastened to the shoe.

DETAILED DESCRIPTION OF THE DRAWINGS

Figure 23:
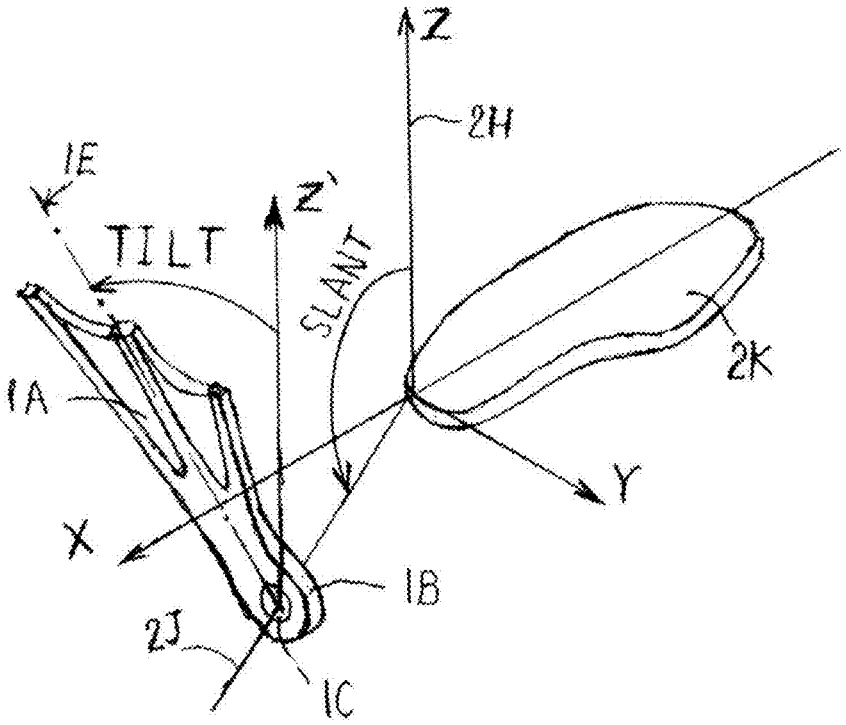
FIG. 23 Describes the Slant and Tilt angles with respect to the left shoe's sole.

FIG. 23 Describes the Slant and Tilt angles with respect to the left shoe's sole. The angle between the left Shoe's vertical axis 2H and the left Fin's axis of symmetry 1E is defined as the left Tilt angle of the left Fin 1A. The left/right Shoe's vertical axis 2H/R2H is a line pointing upwards (Z axis and its parallel axis Z' in FIG. 23), which is perpendicular to the plane of the soles of the corresponding left/right shoes 2K/R2K. The left Slant angle is the angle between the left vertical axis 2H and the left Fin's axis of rotation 2J. Similarly, the right Slant (not drawn in FIG. 23) angle is the angle between the right vertical axis R2H and the right Fin's axis of rotation R2J.

Figure 1:
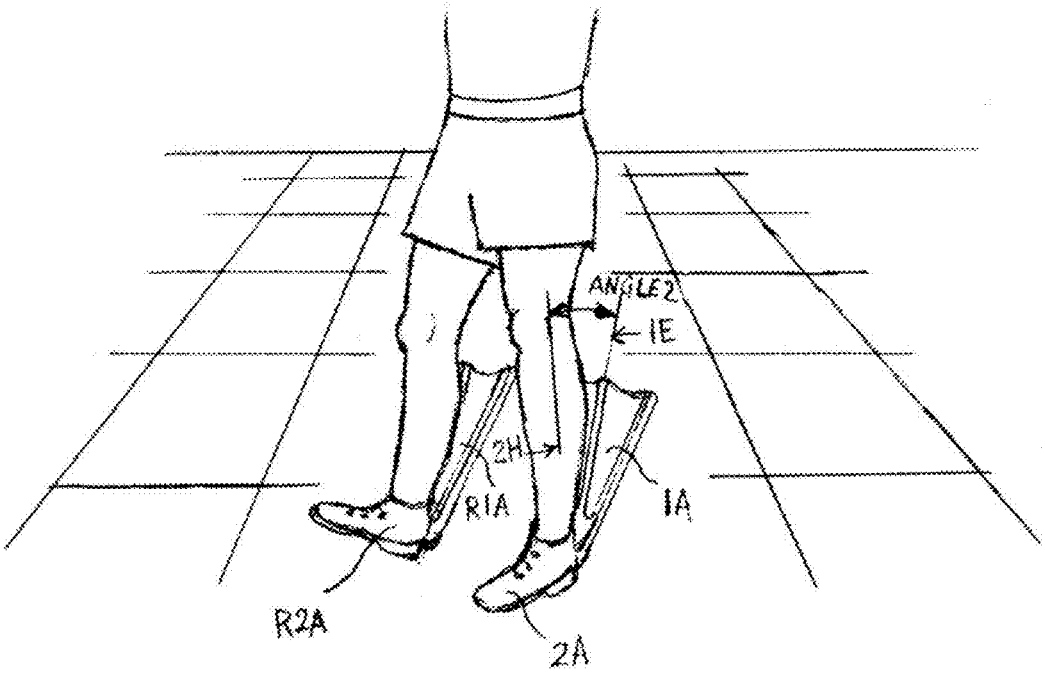
FIG. 1 describes the user with a SDRF in walking positions in which the Fins are folded in upwards Tilted orientations and enable walking.

FIG. 1 describes the user with SDRF in upwards-walking position in which the Fins 1A and R1A are in upwards orientations and enable walking. The left leg Fin 1A and the right leg Fin R1A are rotatably attached to the rear sides of the swimmer left shoe 2A and right shoe R2A respectively. The Fins and are in an upwards-walking position and they are positioned behind the swimmer's calves. Also drawn is the tilt Angle2 i.e. the angle between the left shoe vertical axis 211 and the left Fin's axis of symmetry 1E.

Figure 3:
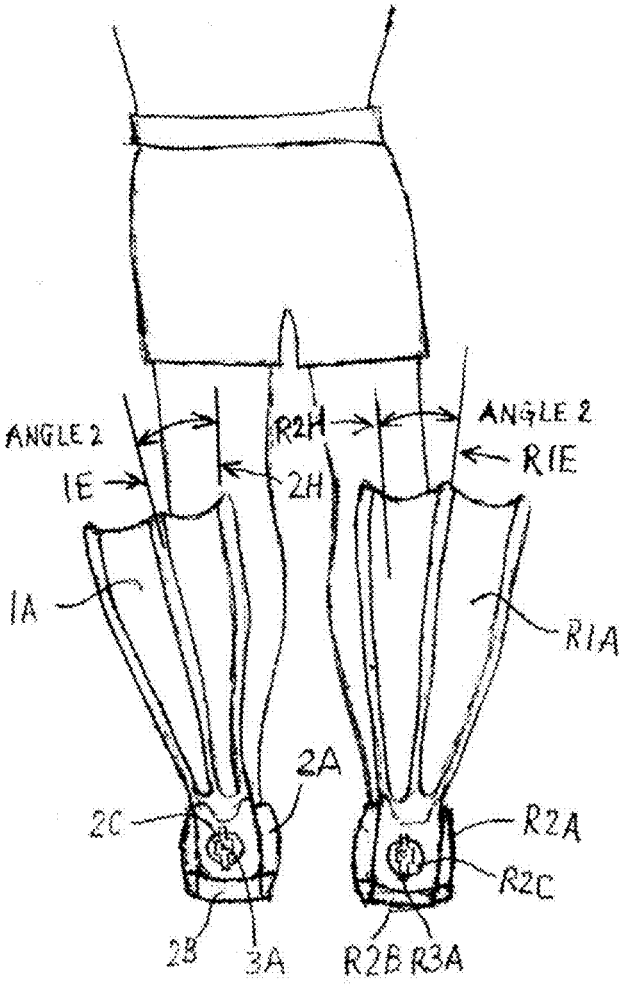
FIG. 3 illustrates the rear view of a swimmer with a SDRF in Tilted walking positions in which the left leg Fin is Tilted to the left and the right leg Fin is Tilted to the right. It is obvious that the Tilted upwards positions provide a wider inner spacing between the Fins which enable unhindered walking.
Figure 6:
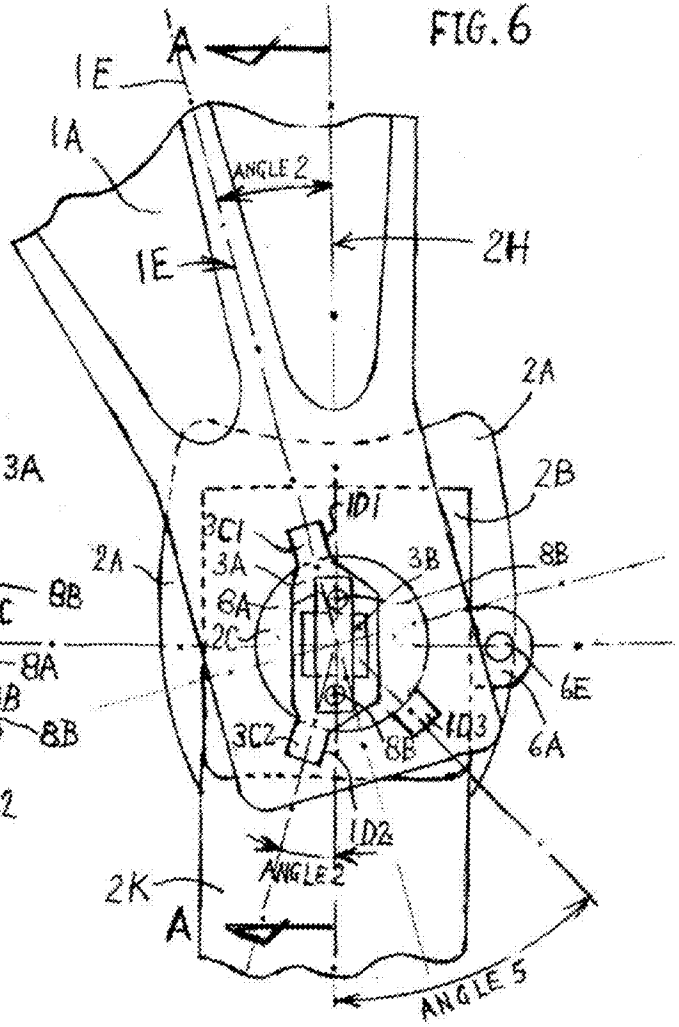
Figure 5:
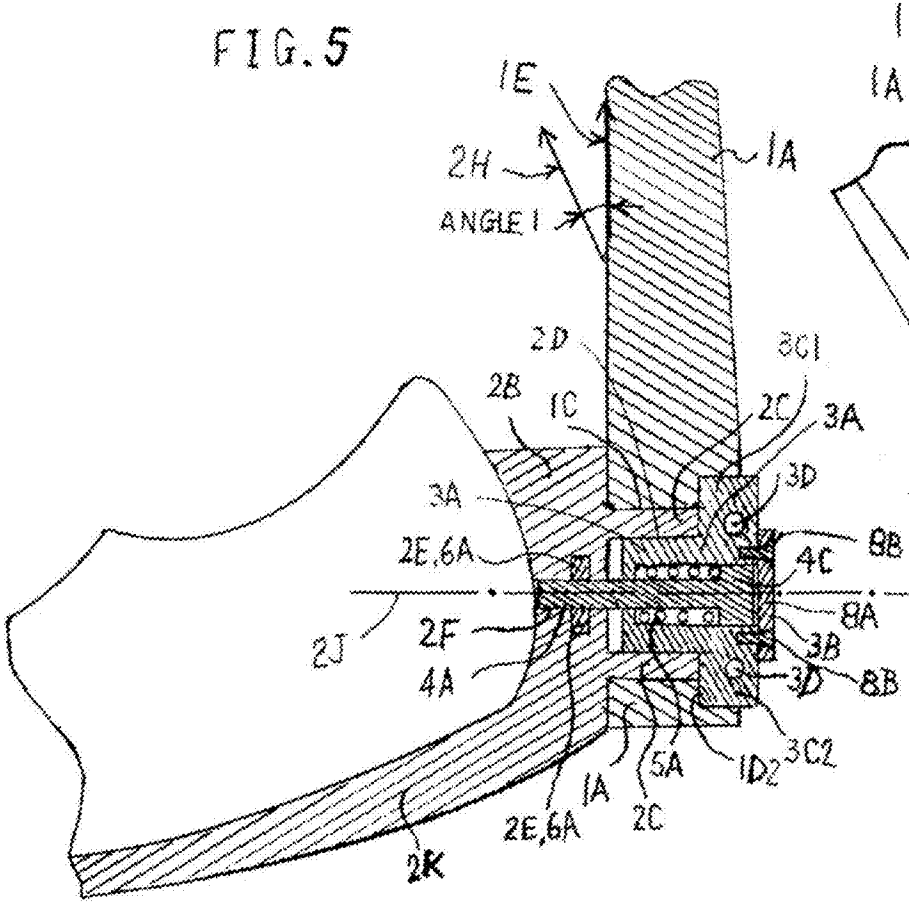
FIG. 5 is a cross section side view of FIG. 6 which illustrates a front view of the left leg part of the SDRF in an upwards-walking position that enables walking.
Figures 7, 8:
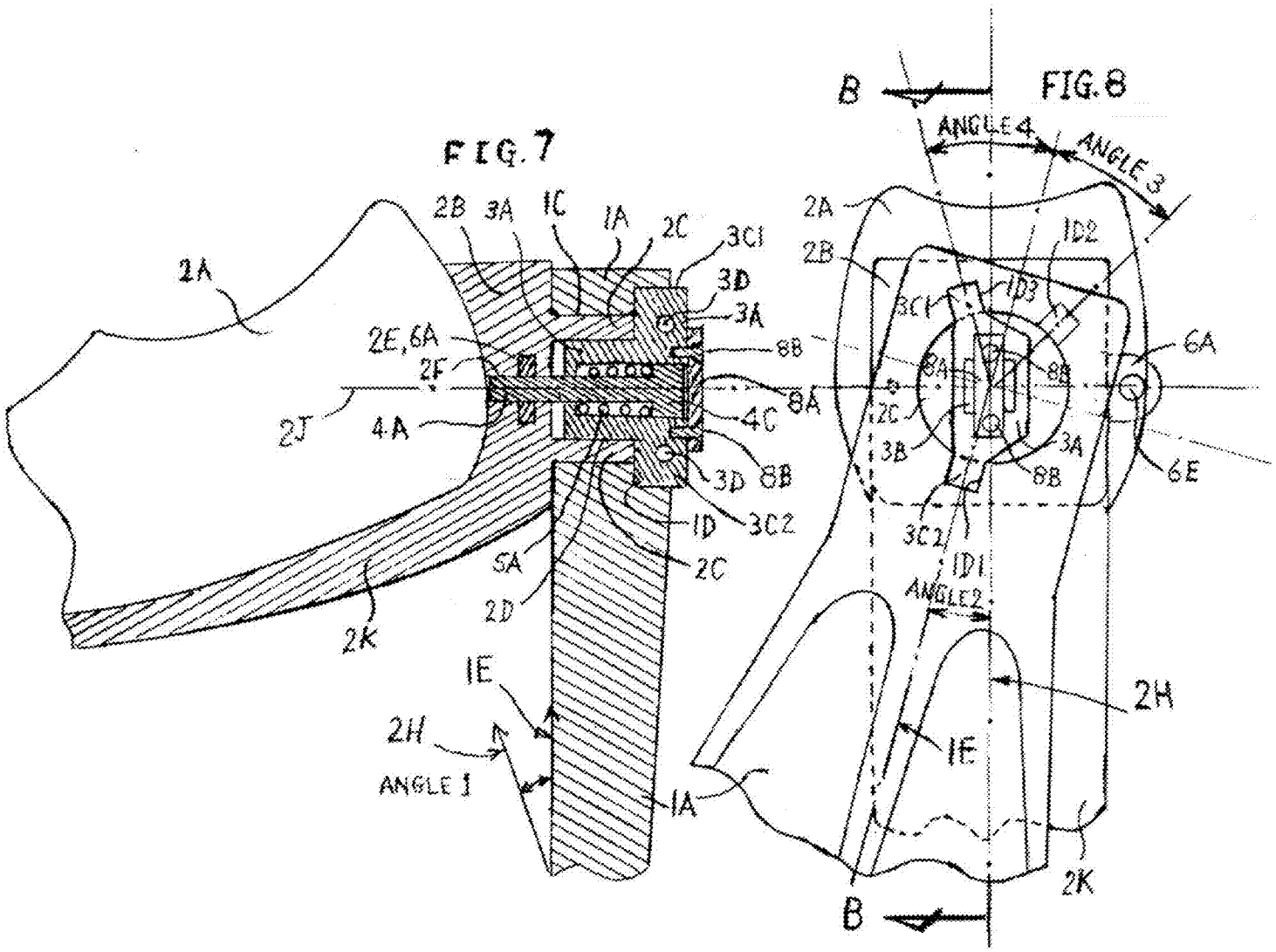
FIG. 7 is a cross section side view of FIG. 8 which illustrates a front view of the left leg part of the SDRF in downwards-swimming position that enables swimming.
Figure 21:
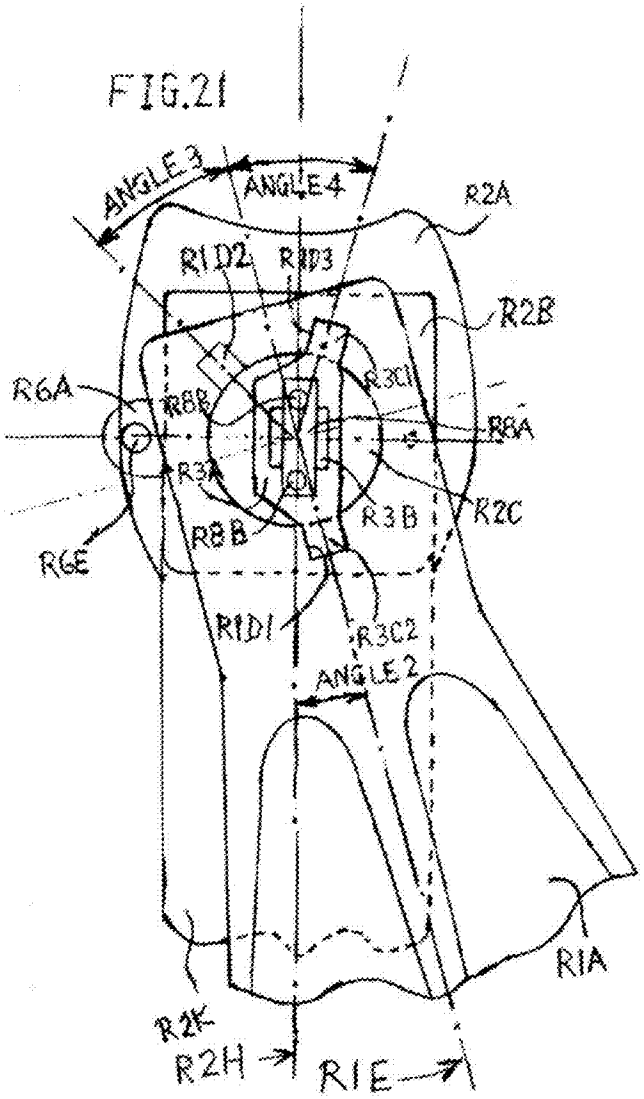
FIG. 21 illustrates a front view of the right leg part of the SDRF in downwards—swimming position which enables swimming.
Figure 20:
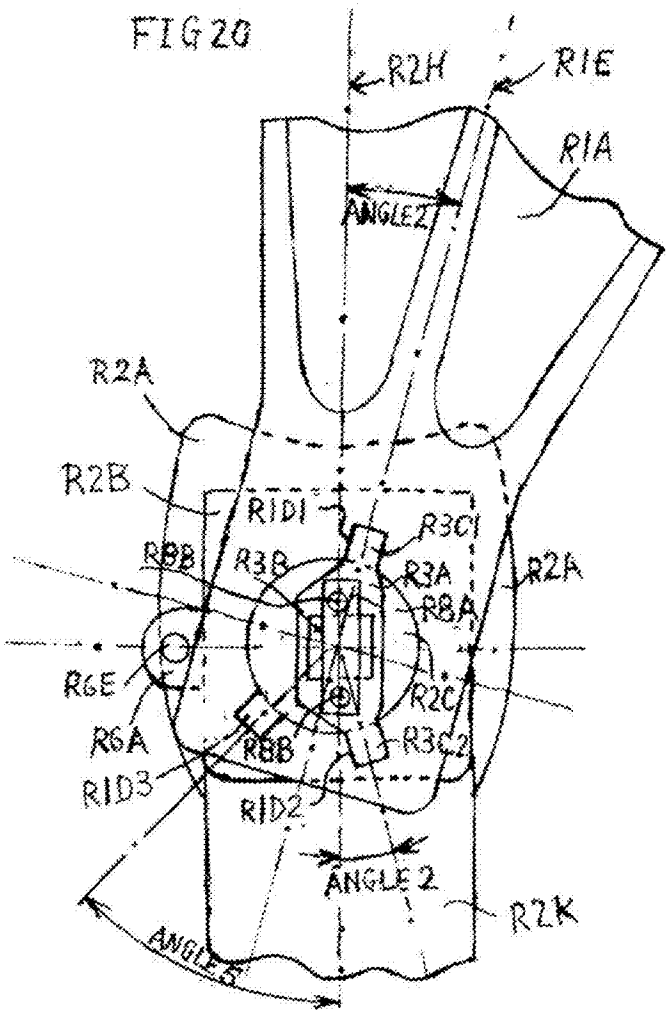
FIG. 20 is a front view of the right leg part of the SDRF in an upwards—walking position that enables walking.
Figure 22:
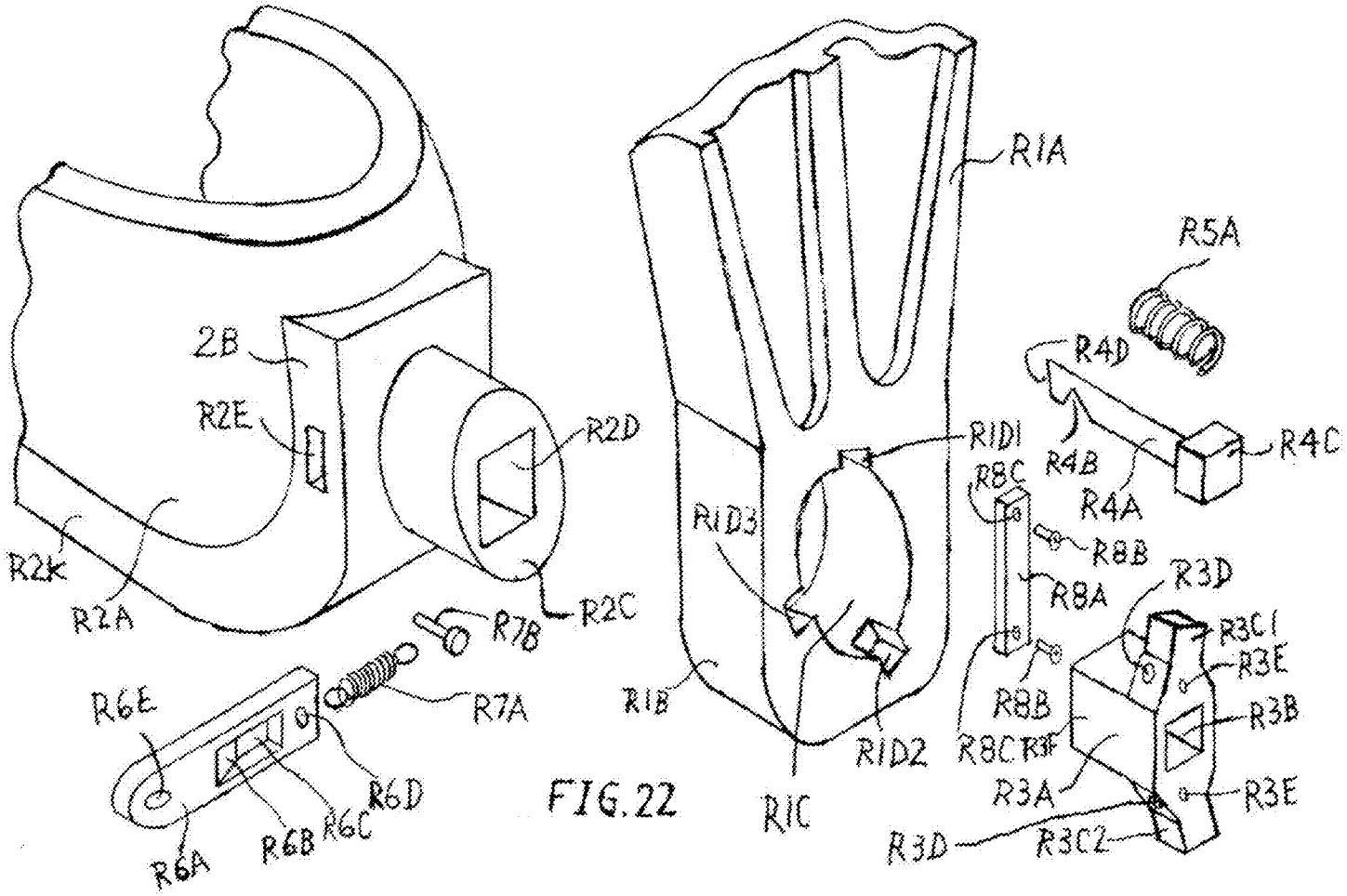
FIG. 22 depicts a 3D isometric drawing of a disassembled right leg part of the SDRF with all its parts.

In the walking position the Fins' longitudinal axes of mirror symmetry are slightly Tilted with respect to the user's calves. These tilted orientations, which are described in FIGS. 1 and 3 are designed to enable walking without obstruction i.e. without mutual collisions of the Fins, with the ground or with the calves. In the upwards position, the left leg Fin 1A is Tilted to the left by Angle2 (as illustrated in FIGS. 3 and 6, 8) and the right leg Fin R1A is Tilted to the right by Angle2. Thus the left and right Tilt angles are equal to Angle2 which is measured between the left/right Fin's axes of symmetry 1E/R1E and the left/right vertical axes 2H/R2H. The left/right axes of rotation 2J/R2J of the left leg and right leg Fins are also slanted backwards by Angle1+90 with respect to the left/right Shoes' vertical axis 2H/R2H (as illustrated in FIGS. 5, 7 and 23). The left/right Slant is actually measured between the left/right axes of rotation 2J/R2J and the left/right vertical axes 2H/R2H which are perpendicular to the left/right soles' planes thus, the official Slant is actually 90+Angle1. The right leg Fin R1A is a mirror image of the left leg Fin 1A (as shown in FIGS. 20, 21 and 22). It means that all the features of the right leg Fin R1A correspond to symmetric features of the left leg Fin 1A wherein the line of symmetry is the vertical axis at the midpoint between the shoes 2A, R2A. Thus, in the upwards position, the right leg Fin R1A is Tilted to the right by Angle2 and also Slanted backwards by Angle1+90 with respect to the vertical axis of the right shoe R2H. Hence, in the upwards position, the two Fins 1A, R1A are Tilted outwards in symmetric angles (Angle2) that prevent the Fins 1A, R1A from hitting one the other while walking. Left and right Fins' axes of rotation 2J/R2J are also slanted backwards by Angle1+90 with respect to the left/right shoe vertical axes 2H/R2H which enables walking without the Fins hitting the user's calves from behind. In one embodiment we approximate both angles Angle1 and Angle2 to be in the range between 5 to 30 degrees. However, these angles could have other values as well.

Figure 2:
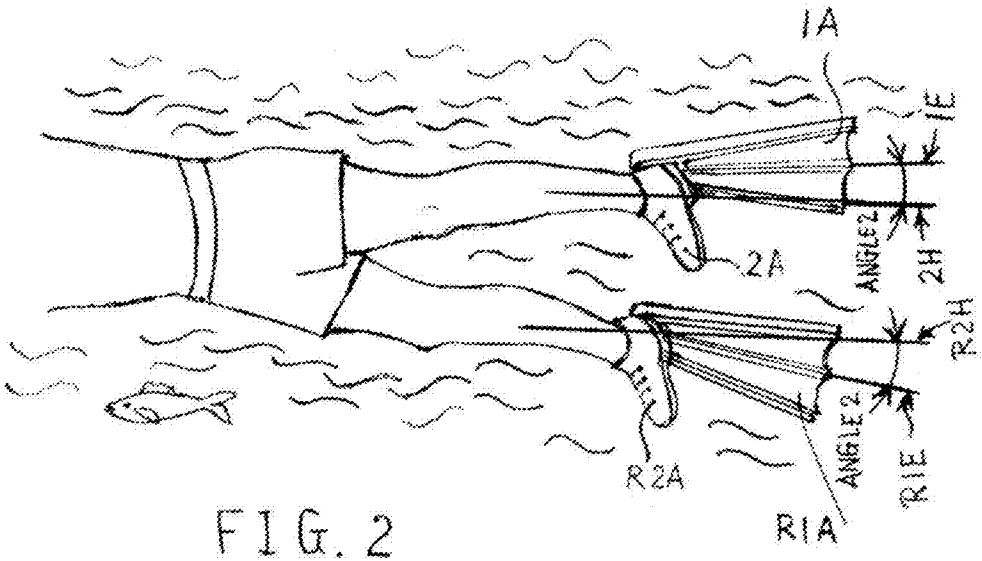
FIG. 2 describes the user with a SDRF in swimming position in which the Fins are in downwards orientations and enable swimming.

FIG. 2 describes the user with SDRF in downwards-swimming position in which the Fins 1A, R1A are in downwards orientations and enable swimming. When the user wants to use the SDRFs for swimming the user unfolds each Fin by rotating it around its shaft by 180−2·Angle2 degrees. This rotates the left leg Fin 1A into a downwards orientation in which the left Fin axis of symmetry 1E is Slanted to the left by Angle2 with respect to the left shoe vertical axis 2H pointing downwards, which coincides with straight extension of the left calf (as illustrated in FIGS. 2 and 8). The right leg Fin also is rotated into a downwards orientation in which the right leg Fin is Tilted to the right by Angle2 with respect to the right shoe vertical axis R2H pointing downwards, which coincides with straight extension of the right calf (as illustrated in FIGS. 2 and 21). Thus, in the downwards position, the Fins are Slanted outwards in such angles that prevent the Fins from mutual collision while swimming.

While in downwards-swimming position, both Fins are also Slanted forwards by Angle1 with respect to the left/right shoes' vertical axis 2H/R2H pointing downwards, which coincide with the straight line extensions of the calves. This forwards Slanted orientation is ideal for swimming because swimmers tend to turn their feet slightly backwards when they swim to reduce the drag of their feet in the water. Turning the feet backwards approximately cancels the Slant forwards by Angle1 as measured between left/right vertical axes 2H/R2H and the left/right Fins' axes of symmetry 1E/R1E and the Fins are oriented in the direction of the swimming water flow and have minimal drag on the swimmer. In this aspect, the Fins' orientations in the SDRF have significant swimming advantage over the traditional prevalent Fins which are mounted with orientations of their planar wide sections which are extensions of the swimmer's feet soles. Since the feet soles orientations with respect to the calves have quite large differences, the traditional Fins exhibit large drag on the swimming water flow compared to the SDRF.

FIG. 3 illustrates the rear view of a swimmer with the left leg Fin 1A and the right leg Fin R1A in upwards-walking positions in which the left leg Fin 1A is Tilted to the left by Angle2 which is the angle between left shoe's vertical axis 2H and left fin axis of symmetry 1E. The right leg Fin R1A is Tilted to the right by Angle2 which is the angle between right shoe's vertical axis R2H and right Fin's axis of symmetry R1E. From FIG. 3, it is obvious that the Tilted upwards positions provide a wider inner spacing between the Fins which enables the user to walk without causing Fins collision.

Figure 4:
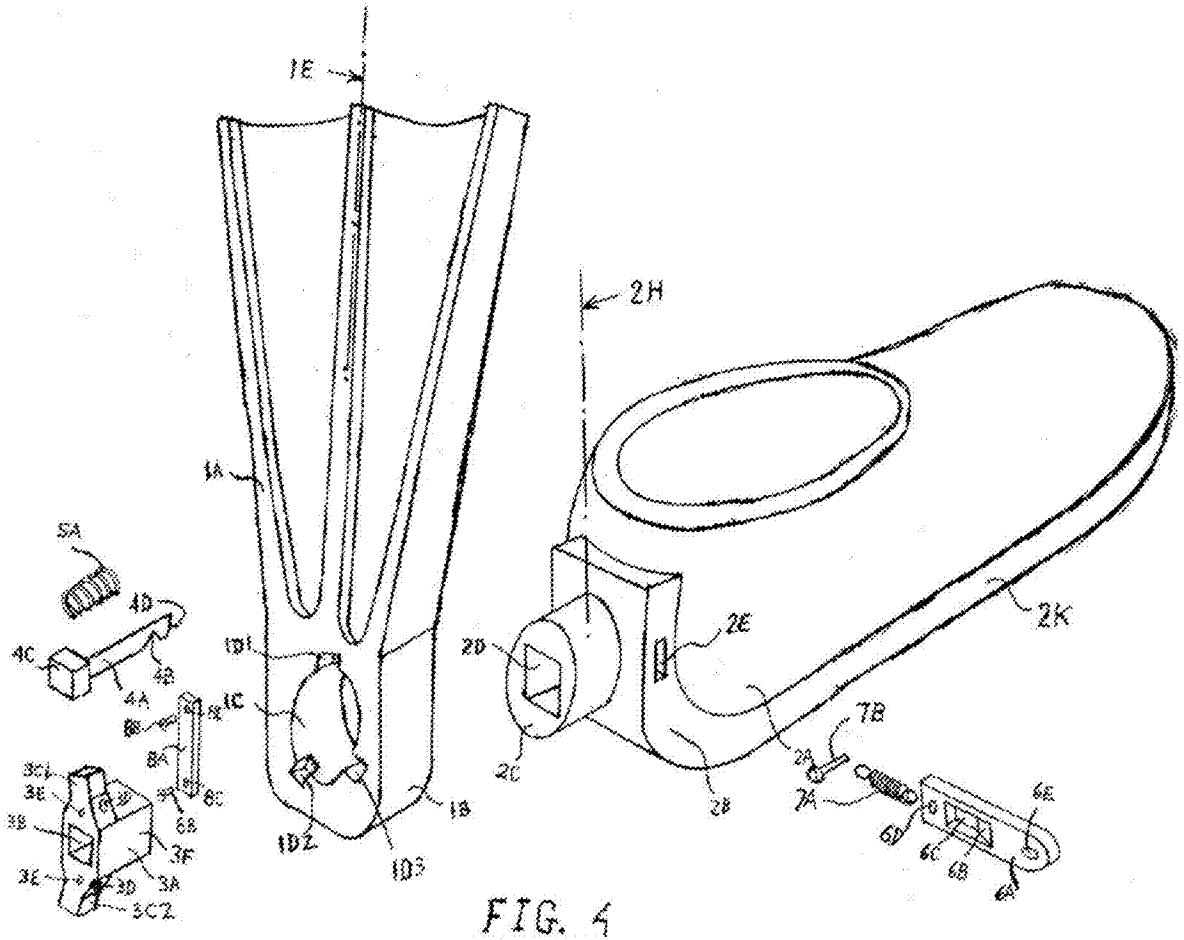
FIG. 4 is a 3D isometric drawing of a disassembled left leg Fin's mechanism with all its parts.
Figure 12:
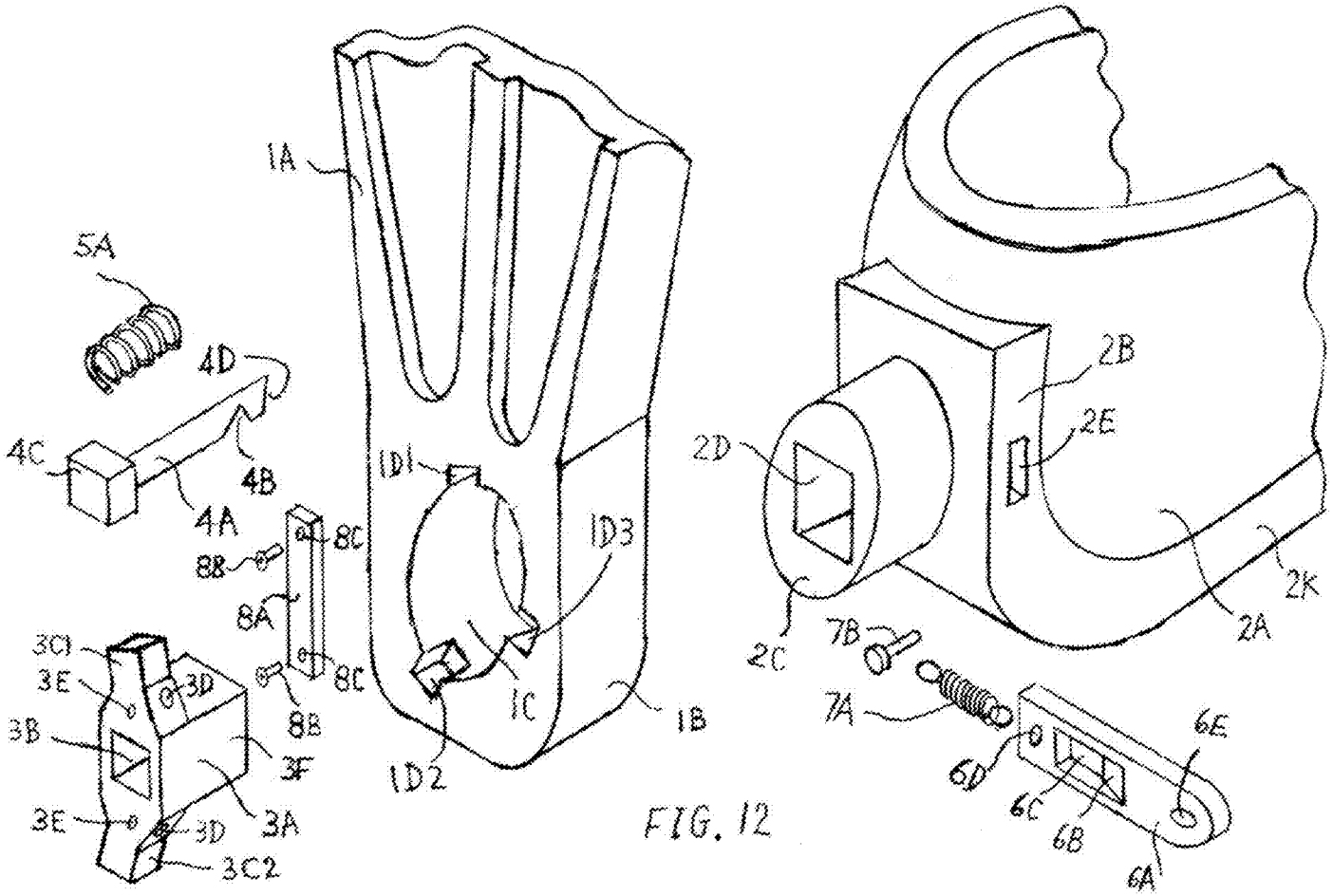
FIG. 12 is an enlargement of FIG. 4 which depicts a 3D isometric drawing of a disassembled left leg part of the SDRF with all its parts.

FIG. 4 is a 3D isometric drawing of a disassembled left leg part of the SDRF with all its parts. FIG. 12 is an enlargement of FIG. 4. FIG. 22 is a 3D isometric drawing of a disassembled right leg part of the SDRF. Due to the mirror image symmetry between the left leg part of the SDRF and the right leg part of the SDRF, the right leg part of the SDRF has the same parts and features as of the left leg part of the SDRF except that their shapes are mirror images of the left leg part of the SDRF. All the parts and features of the right leg part of the SDRF have the same alphanumeric codes as the codes of the left leg part of the SDRF but with added R in front of each code.

Referring to FIGS. 4 and 12, the base 1B of the left Fin 1A has a left bearing 1C which fits the left shaft 2C connected to the left heel 2B of the shoe 2A. Thus, the left Fin 1A can be turned around the left shaft 2C. The left bearing 1C has 3 left recesses: 1D1, 1D2, 1D3 which are used to lock the angular position the left Fin 1A with respect to the left shoe 2A. The SDRF has a left member 3A with two positioning pins i.e. left protrusions 3C1, 3C2 which are inserted into the left Fin's left recesses at different angular positions—as will be elaborated in following paragraphs. The left member 3A has a polygonal left bar 3F which fits a left polygonal cavity 2D in the left shaft 2C. The left polygonal cavity 2D allows the left member 3A to move along the left shaft 2C axis but not to rotate around it. Thus, the left round bar 4A has a fixed angular orientation with respect to the left shoe 2A. The left member 3A has a left inner square cavity 3B which houses a left round bar 4A with a left square head 4C which fits the left inner square cavity 3B. The left round bar 4A also has a left notch 4B and an left ending ramp 4D at its very end, which are used to latch the left round bar to the left shoe's heel 2B as will explained later. The left compression spring 5A also resides in the left inner square cavity 3B and is installed enveloping the left round bar 4A. The left strip 8A is screwed to the left member 3A using left member screws 8B, which are screwed into left member holes 3E in order to lock the left round bar 4A inside the left inner square cavity 3B. The left shoe's heel 2B houses the left latch 6A in a left tunnel 2E. The left latch 6A has a left opening ramp 6B at the right hand side of the left center opening 6C and a left spring hole 6D which is used to anchor the left extension spring 7A (also housed in the left tunnel 2E). The other end of left extension spring 7A is anchored to the left extension spring screw 7B which is screwed into left shoe's hole 2G (visible only in FIG. 10). As already mentioned, FIG. 22 which illustrates the corresponding blow up of the positioning and latching mechanisms of the right fin R1A has the same description as in this paragraph except that all the alphanumeric codes of the corresponding right hand parts have the letter R in front:

Referring to FIG. 22, the base R1B of the right Fin R1A has a bearing R1C which fits the shaft 2C connected to the right heel R2B of the right shoe R2A. Thus, the right Fin R1A can be turned around the right shaft R2C. The right bearing R1C has 3 pin recesses: R1D1, R1D2, R1D3 which are used to lock the angular position the right Fin R1A with respect to the right shoe R2A. The SDRF has a right member R3A with two positioning pins i.e. right protrusions R3C1, R3C2 which are inserted into the Fin's pin recesses at different angular positions—as will be elaborated in following paragraphs. The right member R3A has a polygonal right bar R3F which fits a right polygonal cavity R2D in the right shaft R2C. The right polygonal cavity R2D allows the right member R3A to move along the right shaft R2C axis but not to rotate around it. Thus, the right round bar R4A has a fixed angular orientation with respect to the right shoe R2A. The right member R3A has a right inner square cavity R3B which houses a right round bar R4A with a right square head R4C which fits the right inner square cavity R3B. The right round bar R4A also has a right notch R4B and a right ending ramp R4D at its very end, which are used to latch the right round bar to the right shoe's heel 2B as will explained later. The left compression right spring R5A also resides in the right inner square cavity R3B and is installed enveloping the right round bar R4A. The right strip R8A is screwed to the right member R3A using right member screws R8B screwed into right member holes R3E in order to lock the right round bar R4A inside the right inner square cavity R3B. The right shoe's heel R2B houses the right latch R6A in a right tunnel R2E. The right latch R6A has a right opening ramp R6B at the left hand side of the right center opening R6C and a right spring hole R6D which is used to anchor the right extension spring R7A (also housed in the right tunnel R2E). The other end of the right extension spring R7A is anchored to the right extension spring screw R7B which is screwed into right shoe's hole R2G (visible only in FIG. 10).

FIGS. 5, 6, 7 and 8 describe the Fin positioning mechanism of the left leg part of the SDRF. The positioning mechanism of the right leg Fin which is described in FIGS. 20, 21 and 22, has the same part and feature alphanumeric codes preceded with an R. The left Fin 1A has a left bearing 1C which is mounted on a cylindrical left shaft 2C which is attached to the left heel 2B. The cylindrical left bearing 1C is located at the left Fin's basis 1B. The left bearing 1C has three left recesses: 1D1, 1D2, 1D3 around its circumference which are used for the left Fin's positioning. Left recess number 1 1D1 is positioned upwards at the left fin axis of symmetry. Left recess number 2 1D2 is positioned downwards with 180−2*Angle2 degrees spaced in counterclockwise direction from the left axis of symmetry. Wherein Angle2 is equal to the left tilt angle and also to the right tilt angle. Left recess number 3 is located at 180+2*Angle2 degrees spaced in counterclockwise direction from the left axis of symmetry. The set of left walking recesses includes left recess number 1 1D1 and left recess number 2 1D2. The set of left swimming recesses includes left recess number 1 1D1 and left recess number 3 1D3. It means that at left walking position the left protrusion number 1 i.e. 3C1 is inserted in left recess number 1 i.e. 1D1 and left protrusion number 2 i.e. 3C2 is inserted in left recess number 2 i.e. 1D2. Whereas, at left swimming position the left protrusion number 1 i.e. 3C1 is inserted in left recess number 3 i.e. 1D3 and left protrusion number 2 i.e. 3C2 is inserted in left recess number 1 i.e. 1D1.

FIGS. 20, 21 and 22 describe the Fin positioning mechanism of the right leg part of the SDRF. The right Fin 1A has a right bearing 1C which is mounted on a cylindrical right shaft 2C which is attached to the right heel 2B. The cylindrical right bearing 1C is located at the right Fin's basis 1B. The right bearing 1C has three right recesses: 1D1, 1D2, 1D3 around its circumference which are used for the right Fin's positioning. Right recess number 1 1D1 is positioned upwards at the right fin axis of symmetry. Right recess number 2 1D2 is positioned downwards with 180−2*Angle2 degrees spaced in counterclockwise direction from the right axis of symmetry. Right recess number 3 is located at 180+2*Angle2 degrees spaced in counterclockwise direction from the right axis of symmetry. The set of right walking recesses includes right recess number 1 1D1 and right recess number 2 1D2. The set of right swimming recesses includes right recess number 1 1D1 and right recess number 3 1D3. It means that at right walking position the right protrusion number 1 i.e. 3C1 is inserted in right recess number 1 i.e. 1D1 and right protrusion number 2 i.e. 3C2 is inserted in right recess number 2 i.e. 1D2. Whereas, at right swimming position the right protrusion number 1 i.e. 3C1 is inserted in right recess number 3 i.e. 1D3 and right protrusion number 2 i.e. 3C2 is inserted in right recess number 1 i.e. 1D1.

The cylindrical axes of the left and the right shoes (2C and R2C respectively) which are attached to the shoes' heels (2B, R2B respectively) have polygonal cavities (2D, R2D respectively) which house respective left and right members (3A, R3A) with fitting polygonal bars (3F, R3F respectively). These members also have two protrusions (3C1, 3C2 left protrusions for the left member and R3C1, R3C2 right protrusions for the right member). The left fin 1A has 3 left recesses (1D1, 1D2, 1D3) and the right fin R1A has right recesses (R1D1, R1D2, R1D3). Due to the fitting left and right polygonal bars (3F, R3F respectively) of the corresponding left and right members (3A, R3A) the orientations of the left and right members are fixed with respect to the left and right shoes (2A, R2A respectively). Thus, when the protrusions are inserted into the recesses, the orientations of the left and right Fins (1A, R1A respectively) are also locked with respect to the corresponding left and right shoes (2A, R2A).

FIGS. 5, 6 describe the SDRF of the left leg Fin in upwards-walking position. When the left protrusion 3C1 is inserted into the left recess 1D1 of the left Fin and the left protrusion 3C2 is inserted into the left recess 1D2, as illustrated in FIG. 6, the left Fin is locked in the upwards-walking position which allows walking. Since left recess 1D1 is Tilted at Angle2 with respect to the vertical axis of the shoe 211, the left leg Fin is locked at Tilted orientation at Angle2 to the left with respect to the left calf. Tilting the left leg Fin to the left and the right leg Fin to the right i.e. outwards, prevents mutual collision of the Fins when the user walks with them.

FIGS. 20 and 21 describe the SDRF of the right leg. The right leg Fin is a mirror image of the left leg Fin's SDRF. Thus all the angles in the right leg SDRF have the same values as in the left leg SDRF and the right leg Fin is Tilted at Angle2 to the right enabling walking without collision with the left leg Fin. When the right protrusion R3C1 is inserted into the right recess R1D1 of the right Fin R1A and the right protrusion R3C2 is inserted into the right recess R1D2, as illustrated in FIG. 20, the right leg Fin is locked in the upwards-walking position which allows walking. Since locking pin R1D1 is Tilted at Angle2 to the right with respect to the vertical axis of the shoe, the right Fin is locked at Tilted orientation at Angle2 to the right with respect to the right calf. Tilting the right leg Fin to the right i.e. outwards, prevents mutual collision of the Fins when the user walks with them.

FIGS. 7 and 8 describe the left leg SDRF at a downwards-swimming position when the left protrusion 3C1 is inserted into the left recess 1D3 of the left Fin and left protrusion 3C2 is inserted into the left recess 1D1, the left Fin 1A is locked in the downwards-swimming position which allows swimming. Since left protrusion 3C2 is Tilted at Angle2 downwards to the left with respect to the downwards vertical axis of the left shoe, the left leg Fin is locked at Tilted orientation at Angle2 downwards to the left. FIGS. 6 and 8 describe the SDRF of the left shoe in upwards and downwards orientations respectively.

FIG. 21 describes the right leg SDRF at downwards position at which the right leg Fin R1A is Tilted at Angle2 downwards to the right enabling swimming without collision with the left leg Fin. The downwards position of the right leg Fin is achieved when the right protrusion R3C1 is inserted into the right recess R1D3 of the right Fin R1A and right protrusion R3C2 is inserted into the right recess R1D1, then the right Fin R1A is locked in the downwards-swimming position which allows swimming. Since right protrusion R3C2 is Tilted downwards to the right at Angle2 with respect to the downwards vertical axis of the shoe, the right leg Fin is locked at Tilted orientation at Angle2 downwards to the right. Since the left leg Fin is Tilted to the left by Angle2 at downwards position and the right leg is Tilted to the right by Angle2 at downwards position, the Fins are spaced apart such as to avoid mutual collision at swimming.

FIGS. 6, 8 describe the angular positions of the left part of the SDRF. To fit the Slanted rotation angles the left Fin's protrusions 1C1, 1C2 are spaced at angular displacement of 180−2*Angle2=180−Angle4 degrees. Similarly, the left leg Fin's recesses pairs: 1D1, 1D2 and 1D1, 1D3 also have angular displacements of 180−Angle2 degrees. This leaves the angular displacement between 1D2 and 1D3 to be 4*Angle2=Angle3+Angle4. Measuring in counterclockwise direction from the left Fin's upwards axis of symmetry, the angular locations of the left Fin's recesses which are measured in counterclockwise direction, are 1D1 at zero degrees, 1D2 at 180−2*Angle2=180−Angle4 degrees and 1D3 at 180+Angle4 degrees.

FIGS. 20, 21 describe the angular positions of the right part of the SDRF. For fitting the Slanted rotation angles, the right leg Fin's protrusions R1C1, R1C2 are spaced at angular displacement of 180−2*Angle2=180−Angle4 degrees measured in clockwise direction. The right leg Fin's recesses pairs R1D1, R1D2 and R1D1, R1D3 also have angular displacements of 180−2*Angle2 degrees. This leaves the angular displacement between R1D2 and R1D3 to be 4*Angle2=Angle3+Angle4. Measuring in clockwise direction from the right leg Fin's upwards axis of symmetry, the angular locations of the right leg Fin's recesses are R1D1 at zero degrees, R1D2 at 180−2*Angle2=180−Angle4 degrees and R1D3 at 180+Angle4 degrees.

FIGS. 4, 5, 6, 7, 8, 12, 20, 21 and 22 describe the positioning and locking mechanisms of the left and right parts of the SDRF. The left and right members (3A, R3A respectively) have left and right polygonal bars (3F, R3F respectively) which are inserted into the respective polygonal cavities 2D, R2D centered at the axes of the left and the right shafts i.e. 2C and R2C respectively. Due to the polygonal cavities, the locking members cannot turn around the respective cylindrical shafts' axes 2J, R2J but can move along the axes 2J, R2J of the left and right shafts 2C and R2C respectively. The left and right members 3A, R3A respectively also have left and right inner square cavities 3B, R3B respectively which house left and right round bars 4A, R4A respectively with left and right square heads 4C, R4C which fit the left and right inner cavities 3B, R3B respectively. The left and right round bars 4A, R4A of the left and right parts of the SDRF are fastened to the left and right shoes' heels 2B, R2B respectively with corresponding left and right latches 6A, R6A. As illustrated in FIGS. 5 and 7, the left and right round bars 4A, R4A are enveloped by left and right compression springs 5A, R5A inside the left and right inner cavities 3B, R3B respectively. The left and right springs 5A, R5A are partially compressed and therefore tend to push the left and right members 3A, R3A towards the corresponding left and right shoes' heels 2B, R2B which in turn push the left and right protrusion pairs: 1C1, 1C2 and R1C1, R1C2 into their corresponding left and right Fin's recesses. The left and right springs 5A, R5A also push the corresponding left and right Fins 1A, R1A towards the corresponding left and right shoes' heels 2B, R2B and hold the left and right Fins in place. When the user wishes to change the orientation of a Fin from upwards-walking to downwards-swimming or vice versa, the user can pull against the spring bias the Fin's member away from the shoe. Pulling the member extracts the protrusions from their recesses, unlocks the Fin and allows the user to switch the Fin's orientation by turning the unlocked Fin. The pair of left and right member holes 3D, R3D in the corresponding left and right members 3A, R3A are designed to enable one to tie string loops to the locking members for the purpose of pulling them for switching Fin orientations.

Figures 9, 10:
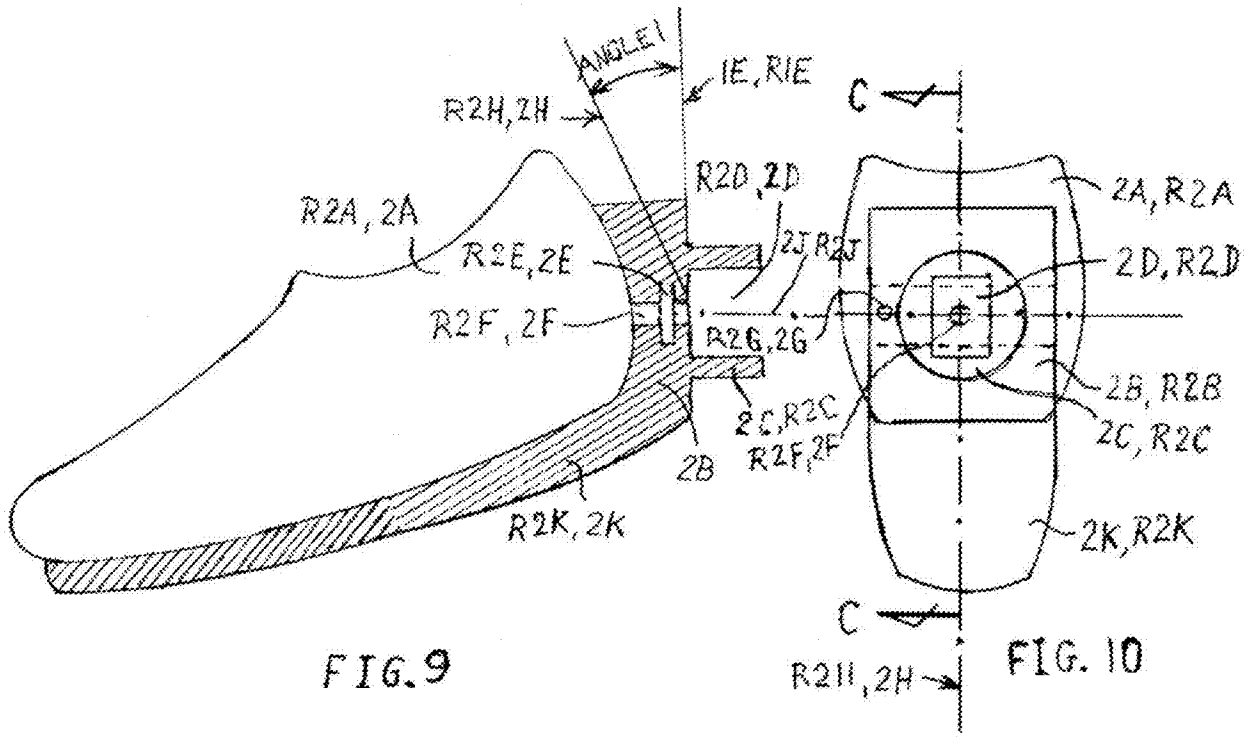
FIG. 9 is a cross section side view of the SDRF's shoe view which is presented in FIG. 10.

FIGS. 9 and 10 describe the front view and cross section side view of the left and right shoes 2A, R2A which have identical shapes. The left and right heels 2B, R2B (which do not include the soles 2K, R2K) are connected to the left and right shafts 2C, R2C respectively which have left and right polygonal cavities 2D, R2D respectively. The left and right shoe holes 2F, R2F are fitted for the left and right round bars 4A, R4A respectively. The left and right tunnels 2E, R2E within the left and right heels 2B, R2B are designed to house the left and right latches 6A, R6A respectively. The left and right extension spring anchoring holes 2G, R2G are for the left and right anchoring screws 7B, R7B respectively which anchor one end of the left and right extension springs 7A, R7A. FIGS. 5, 7, and 9 also depict Angle1 which is the Slant angle backwards of the Fins when they are in upwards-walking positions.

Figure 11:
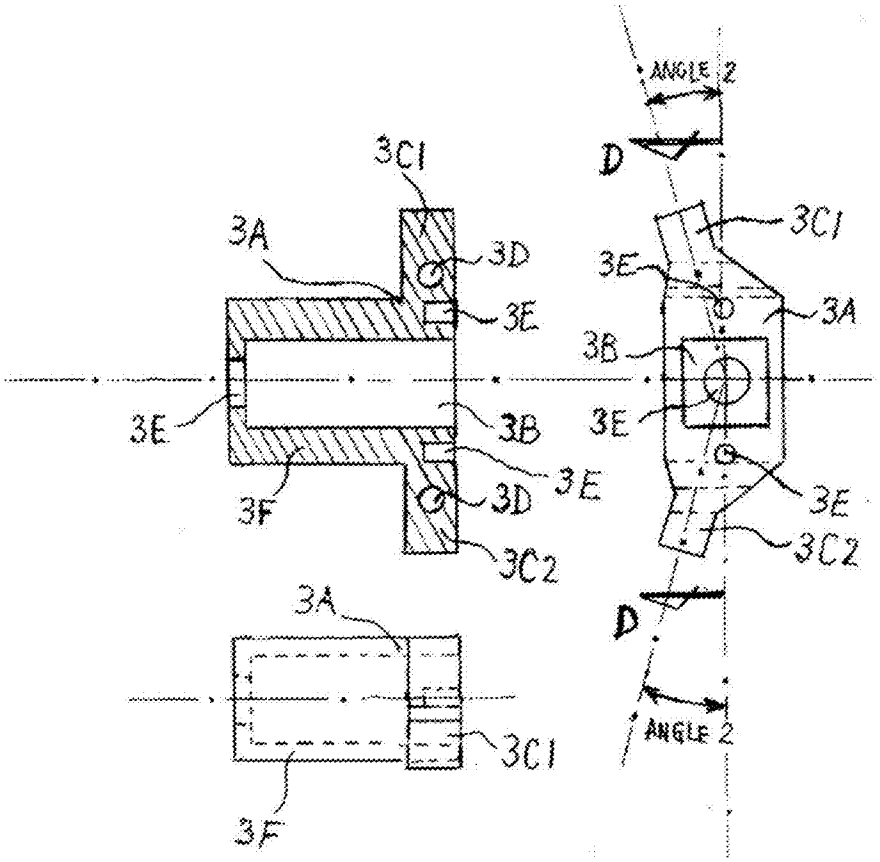
FIG. 11 describes 3 views of the left member for the left leg part of the SDRF.

FIG. 11 illustrates 3 views of the left member 3A. The left member has two left protrusions 3C1, 3C2 which are inserted into fitting left recesses of the left Fin and lock the left Fin's angular position with respect to the left shoe 2A. The left member 3A has a left inner square cavity 3B which holds the left round bar 4A and the left compression spring 5A. The two left strip holes 3E are for the left strip screws 8B which hold the left strip 8A. The two left member holes 3D are for tying a string which could help in pulling the left member when one wants to rotate the left Fin from one position to the other position.

FIG. 13 is a front view of the left latch 6A also of right latch R6A which has identical shape. FIG. 14 is a cross section side view of the left and right latch in FIG. 13. The left and right shoes' rear sides 2B, R2B house the left and right latches 6A, R6A in the left and right tunnels 2E, R2E respectively. The left and right latches 6A, R6A have corresponding left and right opening ramps 6B, R6B at one end of their respective left and right center openings 6C, R6C. The left and right latches 6A, R6A also have left and right latch anchoring holes 6D, R6D which are used to anchor the left and right extension springs 7A, R7A respectively. The left and right extension springs 7A, R7A are also housed in left and right tunnels 2E, R2E respectively. The other ends of left and right extension springs 7A, R7A are anchored to the left and right extension springs anchoring screws 7B, R7B respectively which are screwed into left and right anchoring holes 2G, R2G respectively (holes 2G, R2G are visible only in FIG. 10). Left and right latch holes 6E, R6E are used to tie strings which help in pulling the left and right latches in order to detach the left and right Fins from the left and right shoes respectively.

FIGS. 15-18 describe step by step the action of the latching mechanism by which the left and right Fins are fastened to the left and right shoes. Since Latch 6A is identical to latch R6A we describe in FIGS. 13-15 only the left latch 6A. In FIG. 15 the left ramp 4D of the left round bar 4A is not yet touching the left latch's opening ramp 6B. In FIG. 16, the left round bar advances to the right and the left ending ramp 4D of the left round bar 4A is sliding on the left latch's opening ramp 6B. This causes the left latch 6A to slide downwards. In FIG. 17 the left round bar advances even more to the right and the left ending ramp 4D of the left round bar 4A was sliding on the left latch's opening ramp 6B to its maximal extent. This causes the left latch 6A to slide maximally downwards until the left round bar can pass through the left latch's center opening 6C. In FIG. 18 the left latch 6A springs back into the left round bar's left notch 4B and the left round bar is now latched i.e. locked into its forward position.

Figure 19:
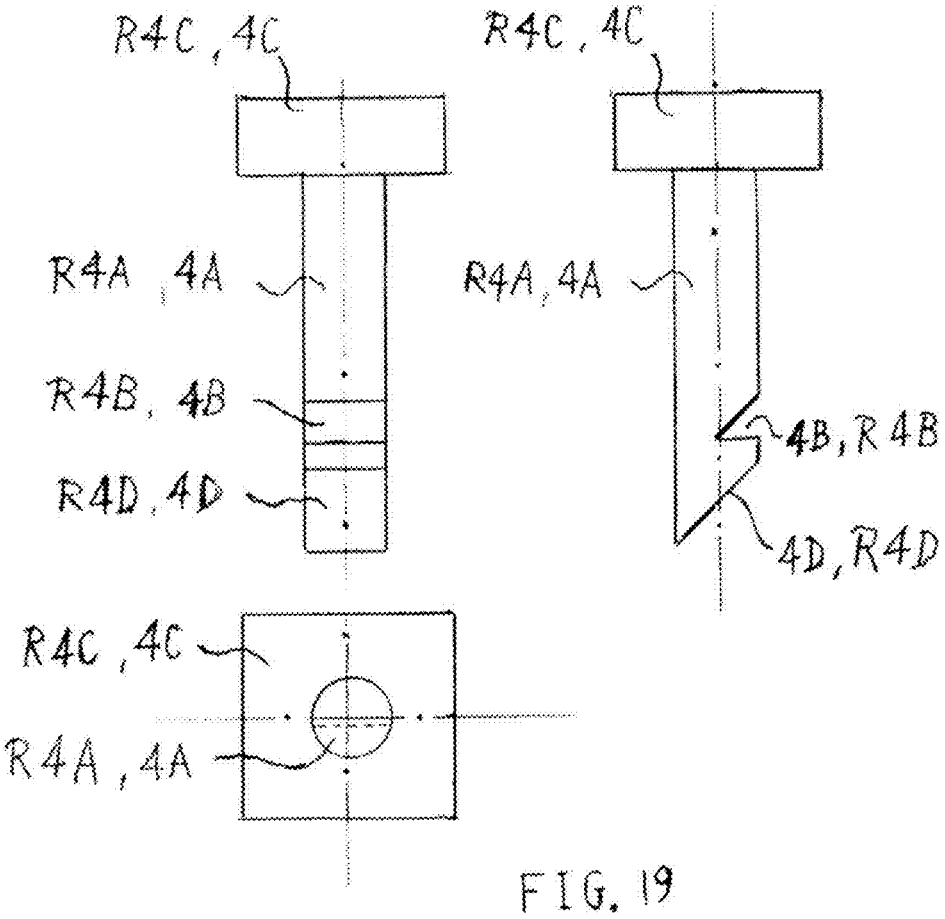
FIG. 19 presents 3 views of the round bar which is used for latching the Fin to the shoe.

FIG. 19 presents 3 views of the left and right round bars 4A, R4A which are used for latching the left and right Fins 1A, R1A to the left and right shoes 2A, R2A respectively. The left and right round bars have left and right notches 4B, R4B respectively for latching, The left and right ending ramps 4D, R4D which are used to slide on the left and right latches' opening ramps and left and right square heads 4C, R4C which fit the left and right inner square cavities 3B, R3B of the left and right members 3A, R3A respectively.

The user can also detach or attach the Fins to the shoes. This is a valuable SDRF feature which enables to separate the Fins from the shoes for more compact packing or carrying. When the left and right Fins 1A, R1A are attached to the left and right shoes 2A, R2A respectively, they are held by their corresponding left and right round bars 4A, R4A which are fastened to the left and right shoes' heels 2B, R2B by left and right latches 6A, R6A respectively. When the left and right Fins are latched, the left and right latches opening ramps 6B, R6B are inserted into the left and right notches 4B, R4B respectively. The steps of latching are describes in FIGS. 15-18. The left and right latches 6A, R6A slide inside left and right tunnels 2E, R2E and they are pulled towards the left and right heels' 2B, R2B centers by left and right extension springs 7A, R7A respectively. The left and right latches 6A, R6A have Slanted left and right opening ramp surfaces 6B, R6B which fit the left and right ending ramp surfaces 4D, R4D at the tip of the left and right round bars 4A, R4A.

When the user wants to attach the left and right Fins to the left and right shoes, the user pushes their left and right round bars 4A, R4A towards their respective left and right latches 6A, R6A. This can be done simply by pushing the left and right members 3A, R3A towards the shoes' left and right rear ends 2B, R2B respectively. The left and right round bars 4A, R4A are also being pushed since the left and right round bars are locked inside their left and right inner cavities 3B, R3B respectively by left and right strips 8A, R8A which are fastened to the top of the locking members by left and right strip screws 8B, R8B respectively. Pushing the left and right round bars' ending ramps onto the left and right latches' opening ramps causes the left and right latches to slide backwards against the left and right extension springs' 7A, R7A biases. As the left and right latches are being pushed backwards the left and right round bars are moving forwards until the left and right latches 6A, R6A are fully retracted and allow the left and right round bars to slide through the left and right latches' center openings 6C, R6C. This moves forwards the corresponding left and right round bars' notches 4B, R4B until they reach the tips of the left and right latches' opening ramps. At that point the left and right latches 6A, R6A are pulled back by their respective left and right extension springs 7A, R7A respectively into the left and right round bar's notches 4B, R4B respectively latching them to the shoes' left and right rear ends 2B, R2B respectively. The whole latching process is illustrated by FIGS. 13-18.

When the user wants to detach the Fins from the shoes, the user can pull the left and right latches 6A, R6A by pulling at their left and right tips 6E, R6E. This pulls out the left and right opening ramps 6B, R6B from the left and right round bar's notches 4B, R4B thereby releasing the left and right round bars 4A, R4A from the left and right shoes.

The SDRF includes two Fin mechanisms. However, the left leg Fin mechanism is an exact mirror image of the right leg Fin mechanism. So swimmer worn SDRF has two Fin Mechanisms which are symmetrical with the center vertical line between the legs as the axis of mirror symmetry. The SDRF can be adjusted for swimming or for walking. One embodiment (FIG. 4) of a left leg Fin mechanism includes a Fin 1A which is mounted on a cylindrical shaft 2C connected to the user's shoe's heel 2B and can be rotated into a walking position or into a swimming position. When the Fins are in walking position, they are in upwards orientation (pointing upwards) and the SDRFs enable the user to walk freely. When the Fins are set in swimming position, they are in downwards orientation (pointing downwards) and the SDRF enable the user to swim efficiently with minimal drag.

In the walking position the Fins' longitudinal axes of symmetry (1E in FIGS. 4,5,6,7,8,20,21) are pointing upwards but with slight Slant and Tilt angles. We define Slant as the angle between the axis of Fin's rotation (2J in FIGS. 5,7,9 and 23) and the vertical axis i.e. the normal to the shoe's sole's plane (2H in FIGS. 5,7,9 and 23). We define the left Tilt angle as the angle of rotation on the axis of left Fin's rotation 2J measuring it in counterclockwise direction between the vertical axis i.e. the normal to shoe's sole's plane 211 and the Fin's axis of symmetry (1E in FIGS. 4,5, 6, 7, 8, 23 and R1E in 20,21 for the right leg Fin) when the axis points towards the viewer. Thus, when the Slant angle is 90 degrees the Fin is pointing vertically. When the Slant angle is slightly greater than 90 degrees the Fin is pointing slightly backwards. The Slanted orientations, which are described in FIGS. 1 and 3 are slightly greater than 90 degrees i.e. Slant=90+Angle1 and are designed to enable walking without hitting the calves. Also, in the upwards walking position, the left leg Fin is Tilted to the left by Tilt=Angle2 (as illustrated in FIGS. 3 and 6) and the right leg Fin is tilted to the right by Tilt=Angle2. The right leg Fin is a mirror image of the left leg Fin (as shown in FIGS. 20,21 and 22 for the right leg Fin and in FIGS. 4, 6, 8 and 12 for the left leg Fin). It means that all the features of the right leg Fin correspond to symmetric features of the left leg Fin wherein the axis of mirror symmetry is the vertical axis passing at the center point between the left and right shoes. Thus, in the upwards—walking position, the right leg Fin is Tilted to the right by Angle2 and also Slanted backwards by Angle1 with respect to the right calf and the left leg Fin is slanted backwards by Angle1 and Tilted to the left by Angle2. Hence, in the walking position, the Fins are Tilted outwards in symmetric angles (Angle2) that prevent the Fins from hitting one the other while walking. Both Fins are also Slanted backwards by Angle1 which enables walking without the Fins hitting the calves from behind. In one embodiment we approximate both angles to be in the range between 5 to 30 degrees. However, these angles could have other values as well.

When the user wants to use the SDRFs for swimming the user unfolds each Fin by rotating it around its shaft by 180−2·Angle2 degrees. This rotates the left leg Fin 1A into a downwards orientation in which the left leg Fin is Tilted to the left by 180·Angle2 which means that the left leg Fin is at Angle2 to the left with respect to straight extension of the left calf (as illustrated in FIGS. 2 and 8). The right leg Fin also is rotated into a downwards orientation in which the right leg Fin is Tilted to the right by 180·Angle2 which is equal to a Tilt to the right of Angle2 with respect to straight extension of the right calf (as illustrated in FIGS. 2 and 21). Thus, in the downwards position, the Fins are Tilted outwards by Angle2 to prevent the Fins from hitting one the other while swimming.

While in downwards—swimming position, both Fins are also Slanted forwards by Angle1 with respect to the straight extensions of the calves. This forwards Slanted orientation is ideal for swimming because swimmers tend to turn their feet slightly backwards when they swim to reduce the drag of their feet in the water. Turning the feet backwards approximately cancels the Slant forwards by Angle1 of the Fins' longitudinal axes of symmetry and the Fins are oriented in the direction of the swimming water flow and have minimal drag on the swimmer. In this aspect, the Fins' orientations in the SDRFs have significant swimming advantage over the traditional prevalent Fins which are mounted at orientations which are straight extensions of the swimmer's feet soles. Since the feet soles angles with respect to the calves have quite large differences, the traditional Fins exhibit a large drag on the swimming motion flow compared to the SDRFs.

The Fins' positioning mechanisms of the SDRFs is described as follows (referring here to the left leg Fin described in FIGS. 4, 5, 6, 7, 8, and 12, the right leg Fin which is described in FIGS. 20, 21 and 22 has the same feature alphanumeric codes preceded with an R). Each Fin has a bearing 1C which is mounted on a cylindrical shaft 2C which is attached to the shoe's heel 2B. The cylindrical bearing 1C is located at the Fin's basis 1B. The bearing has three recesses: 1D1, 1D2, 1D3 around its circumference which are used for the Fin's positioning. Recess1 of the left leg Fin 1D1 and recess1 of the right leg Fin R1D1 are positioned upwards at the Fins' axes of symmetry 1E and R1E respectively. Recess2 of the left leg Fin (1D2) is positioned downwards with Angle3=2·Angle2 spaced to the left from the downwards axis of symmetry of the Fin. Recess number 2 of the right leg Fin (R1D2) is positioned downwards with Angle3 spaced to the right from the downwards axis of symmetry of the right leg Fin. Recess number 3 (1D3) of the left leg Fin is positioned downwards with Angle4=2·Angle2 spaced to the right from the Fin's axis of symmetry downwards. With mirror symmetry, recess number 3 of the right leg Fin (R1D3) is positioned downwards with Angle4 spaced to the left from the Fin's axis of symmetry downwards.

The cylindrical axes of the left and the right shoes (2C and R2C respectively) which are attached to the shoes' heels (2B, R2B respectively) have polygonal cavities (2D, R2D respectively) which house respective left and right members (3A, R3A) with fitting polygonal bars (3F, R3F). The left member and right member also have two positioning pins each (3C1, 3C2 for the left member and R3C1, R3C2 for the right member). These positioning pins which fit all 3 recesses (1D1, 1D2, 1D3) of the left leg Fin and (R1D1, R1D2, R1D3) of the right leg Fin. Due to the fitting polygonal bars (3F, R3F) of the locking members (3A, R3A) the orientations of the left and right members is fixed with respect to the left and right shoes (2A, R2A). Thus, when the positioning pins are inserted into the recesses, the orientations of the left leg and right leg Fins (1A, R1A) are also locked with respect to the corresponding left and right shoes (2A, R2A).

When the pin 3C1 is inserted into the recess 1D1 of the left leg Fin and the pin 3C2 is inserted into the recess 1D2, as illustrated in FIG. 6, the left leg Fin is locked in the walking position which allows walking. Since locking pin 1D1 is Tilted at Angle2 with respect to the vertical axis of the shoe, the left leg Fin is locked at Tilted orientation at Angle2 to the left with respect to the left calf (the left leg calf orientation is considered as coinciding with the normal to the left shoe's sole 2H). Tilting the left leg Fin to the left and the right leg Fin to the right i.e. outwards, prevents collision of the Fins when the user walks with them. FIGS. 4, 5, 6, 7 and 8 describe the SDRF of the left leg Fin and FIGS. 20, 21 and 22 describe the SDRF of the right leg Fin.

The SDRF of the right leg Fin (described in FIGS. 20,21 and 22) is a mirror image of the left leg Fin's SDRF. Thus all the angles in the right leg SDRF have the same values as in the left leg SDRF and the right leg Fin is Tilted at Angle2 to the right enabling walking without collision with the left leg Fin. When the pin R3C1 is inserted into the recess R1D1 of the right leg Fin and the pin R3C2 is inserted into the recess R1D2, as illustrated in FIG. 20, the right leg Fin is locked in the upwards-walking position which allows walking. Since locking pin R1D1 is Tilted at Angle2 with respect to the vertical axis of the shoe, the right leg Fin is locked at Tilted orientation at Angle2 to the right with respect to the right calf. Tilting the right leg Fin to the right i.e. outwards, prevents collision of the Fins when the user walks with them.

When the pin 3C1 is inserted into the recess 1D3 of the left leg Fin and pin 3C2 is inserted into the recess 1D1, the left leg Fin is locked in the downwards—swimming position which allows swimming. Since locking pin 3C2 is Tilted at Angle2 downwards with respect to the downwards vertical axis of the shoe, the left leg Fin is locked at Tilted orientation at Angle2 downwards to the left. FIGS. 6 and 8 describe the SDRF of the left shoe in upwards and downwards orientations respectively.

At the swimming position, the SDRF of the right shoe is a mirror image of the left shoe's SDRF. Thus all the angles in the right leg SDRF have the same values as in the left leg SDRF and the right leg Fin is Tilted at Angle2 downwards to the right enabling swimming without collision with the left leg Fin. When the pin R3C1 is inserted into the recess R1D3 of the right leg Fin and pin R3C2 is inserted into the recess R1D1, the right leg Fin is locked in the downwards position which allows swimming. Since locking pin R3C2 is Tilted downwards to the right at Angle2 with respect to the downwards vertical axis of the shoe, the right leg Fin is locked at Tilted orientation at Angle2 downwards to the right. FIGS. 20 and 21 describe the SDRF of the right shoe in upwards and downwards orientations respectively. FIG. 22 describes in 3D isometric drawing of a disassembled right leg SDRF with all its parts.

To fit the Tilted rotation angles the left leg Fin's positioning pins 1C1, 1C2 are spaced at angular displacement of 180−2·Angle2=180 Angle4 degrees. Similarly, the left leg Fin's recess pairs 1D1, 1D2 and 1D1, 1D3 also have angular displacements of 180−2·Angle2 degrees. This leaves the angular displacement between 1D2 and 1D3 to be 4·Angle2=Angle3 Angle4. Measuring in counterclockwise direction from the left leg Fin's upwards axis of symmetry 1E, the angular locations of the left leg Fin's recesses are 1D1 at zero degrees, 1D2 at 180−2·Angle2=180 Angle4 degrees and 1D3 at 180+Angle4 degrees.

Similarly, for fitting the Tilted rotation angles, the right leg Fin's positioning pins R1C1, R1C2 are spaced at angular displacement of 180−2·Angle2=180 Angle4 degrees. The right leg Fin's recess pairs R1D1, R1D2 and R1D1, R1D3 also have angular displacements of 180−2·Angle2 degrees. This leaves the angular displacement between R1D2 and R1D3 to be 4·Angle2=Angle3 Angle4. Measuring in clockwise direction from the right leg Fin's upwards axis of symmetry R1E, the angular locations of the right leg Fin's recesses are R1D1 at zero degrees, R1D2 at 180−2·Angle2−180 Angle4 degrees and R1D3 at 180+Angle4 degrees.

With reference to FIGS. 4, 5, 6, 7, 8, 12, 13-18 and 22, the left and right locking members (3A, R3A respectively) have polygonal bars (3F, R3F) which are inserted into the polygonal cavities 2D, R2D centered at the axes of the left and the right cylindrical shafts: 2C and R2C respectively. Due to the polygonal cavities 2D, R2D, the left and right members 3A, R3A cannot turn around the cylindrical shafts' axes 2J, R2J but can move along the these axes. The left and right members 3A, R3A also have inner square cavities 3B, R3B which house round bars 4A, R4A respectively with square heads 4C, R4C respectively which fit the inner cavities 3B, R3B. The round bars 4A, R4A are fastened to the shoes' heels 2B, R2B respectively with corresponding latches 6A, R6A. As illustrated in FIGS. 5 and 7, the round bars 4A, R4A are enveloped by compression springs 5A, R5A inside the inner cavities 3B, R3B respectively. The springs 5A, R5A are partially compressed and therefore tend to push the left and right members 3A, R3A towards the shoes' heels 2B, R2B respectively, which in turn push the positioning pins pairs 1C1, 1C2 and R1C1, R1C2 into their corresponding Fin's recesses. The springs 5A, R5A also push the Fins towards the shoes' heels and thus hold the Fins in place. When the user wishes to change the orientation of a Fin from upwards to downwards or vice versa, the user can pull the members away from the shoes against the springs biases. Pulling the left and right members extracts the positioning pins from their recesses, unlocks the Fin and allows the user to switch the Fin's orientation by turning the unlocked Fin. The pair of holes 3D, R3D in the corresponding left and right members 3A, R3A are designed to enable one to tie a string loop to the locking member for the purpose of pulling it for switching Fin orientations.

The user can also detach or attach the Fins to the shoes. This is a valuable SDRF feature which enables to separate the Fins from the shoes for more compact packing or carrying. When the Fins 1A, R1A are attached to the shoe 2A, R2A they are held by the round bars 4A, R4A which are fastened to the shoes' soles 2B, R2B by latches 6A, R6A respectively. The latches 6A, R6A slide inside their corresponding tunnels 2E, R2E and they are pulled towards the heels' 2B, R2B centers by extension springs 7A, R7A respectively. The latches 6A, R6A have Slanted ramp surfaces 6B, R6B which fit the ramp surfaces 4D, R4D at the tips of the round bars 4A, R4A respectively.

When the user wants to attach the Fins to the shoes, the user pushes their round bars 4A towards their latches 6A, R6A. This can be done simply by pushing the left and right members 3A, R3A towards the shoes' heels 2B, R2B. The round bars 4A, R4A are also being pushed since the round bars are locked inside their inner cavities 3B, R3B by their corresponding strips 8A, R8A which are fastened to the top of the members by screws 8B, R8B. Pushing the round bars' ramps 4D, R4D onto the corresponding latches' ramps 6B, R6B causes the latches 6A, R6A to slide backwards against the extension springs' 7A, R7A biases. As the latches are being pushed backwards the round bars are moving forwards until the latches are fully retracted and allow the round bar to slide through the corresponding latches' openings 6C, R6C. This moves forwards the round bars' notches 4B, R4B until they reach the tips of the latches' ramps. At that point the latches 6A, R6A are pulled back by their respective extension springs 7A, R7A into the round bar's notches 4B, R4B latching them to the shoes' heels 2B, R2B. The whole latching process is illustrated by FIGS. 13-18.

When the user wants to detach the Fins from the shoes, the user can pull the latches 6A, R6A by pulling at their corresponding tips 6E, R6E. This pulls out the ramps 6B, R6B from the round bar's corresponding notches 4B, R4B thus releasing the corresponding round bars 4A, R4A and their corresponding left and right Fins 1A, R1A from the corresponding shoes 2A, R2A.

The invention claimed is:

1. A swimming device which can be adjusted for swimming or for walking; said swimming device comprising: a left fin, a right fin, a left shoe and a right shoe; wherein said left shoe comprising a left sole and a left heel; wherein said left heel is rigidly attached to said left sole; wherein said left shoe has a left shaft which is attached to said left heel and extends backwards from said left heel; wherein said left shaft is cylindrical and centered along a left axis; wherein said left shoe is worn by a left foot of a user; wherein a left axis vector is defined as a vector which coincides with said left axis and is pointing backwards; wherein said right shoe comprising a right sole and a right heel; wherein said right heel is rigidly attached to said right sole; wherein said right shoe has a right shaft which is attached to said right heel and extends backwards from said right heel; wherein said right shaft is cylindrical and centered along a right axis; wherein said right shoe is worn by a right foot of said user; wherein a right axis vector is defined as a vector which coincides with said right axis and is pointing backwards; wherein said left fin has a left bearing which is rotatably mounted on said left shaft; wherein said right fin has a right bearing which is rotatably mounted on said right shaft; wherein said left fin can be rotated around said left axis and said right fin can be rotated around said right axis; wherein said left fin can be rotated around said left axis into a left swimming position; wherein said right fin can be rotated around said right axis into a right swimming position; whereby, when said left fin is in said left swimming position and said right fin is in said right swimming position, said swimming device can be used for swimming; in addition, said left fin can be retracted from said swimming position into a left walking position by rotating said left fin around said left axis; said right fin can be retracted from said swimming position into a right walking position by rotating said right fin around said right axis; whereby, when said left fin is in said left walking position and said right fin is in said right walking position said swimming device enables said user to walk naturally.

2. The swimming device of claim number 1, wherein when said left fin is in said left walking position and when said right fin is in said right walking position said swimming device enables said user to walk naturally on a floor without said left fin colliding with said right fin, without said left fin colliding with said floor, without said left fin colliding with said user's legs, without said right fin colliding with said floor and without said right fin colliding with said user's legs.

3. The swimming device of claim number 1, wherein when said left fin is in said left swimming position and said right fin is in said right swimming position said swimming device enables said user to swim naturally without said left fin colliding with said right fin and without said left fin colliding with said user's legs and also without said right fin colliding with said user's legs.

4. The swimming device of claim number 1; wherein said left fin comprising a left fin base and a left fin planar section which is attached to said left fin base; wherein, said left fin has a left axis of symmetry; wherein a left axis of symmetry vector is defined as a vector which coincides with said left axis of symmetry and is pointing from said left fin base towards said left fin planar section; wherein said right fin comprising a right fin base and a right fin planar section which is attached to said right fin base; wherein, said right fin has a right axis of symmetry; wherein a right axis of symmetry vector is defined as a vector which coincides with said right axis of symmetry and is pointing from said right fin base towards said right fin planar section;

wherein, an inner product angle between two vectors is defined as an angle having values which are in the range of 0 to 180 degrees; wherein, said left sole has a left sole plane; wherein, a left vertical vector is defined as a vector which is perpendicular to said left sole plane and is pointing upwards; wherein, said left fin's position is defined by a left slant angle and by a left tilt angle; wherein said left tilt angle is defined as said inner product angle between said left vertical vector and said left axis of symmetry vector; wherein said left slant angle is defined as said inner product angle between said left vertical axis vector and said left axis vector; wherein said left fin is in said left walking position when said left fin has a predetermined said left tilt angle which is within the range of 0 to 90 degrees and a predetermined said left slant angle which is within the range of 90 to 180 degrees; wherein said left fin is in said left swimming position when said left fin has a predetermined said left tilt angle which is within the range of 90 to 180 degrees and a predetermined said left slant angle which is within the range of 90 to 180 degrees;

wherein, said right sole has a right sole plane; wherein, a right vertical vector is defined as a vector which is perpendicular to said right sole plane and pointing upwards; wherein, said right fin's position is defined by a right slant angle and by a right tilt angle; wherein said right tilt angle is defined as said inner product angle between said right vertical vector and said right axis of symmetry vector; wherein said right slant angle is defined as said inner product angle between said right vertical axis vector and said right axis vector; wherein said right fin is in said right walking position when said right fin has a predetermined said right tilt angle which is within the range of 0 to 90 degrees and a predetermined said right slant angle which is within the range of 90 to 180 degrees; wherein said right fin is in said right swimming position when said right fin has a predetermined said right tilt angle which is within the range of 90 to 180 degrees and a predetermined said right slant angle which is within the range of 90 to 180 degrees.

5. The swimming device of claim number 4, wherein said left fin planar section is made of elastic and resilient material; wherein said left fin base is made of elastic and resilient material; wherein said right fin planar section is made of elastic and resilient material; wherein said right fin base is made of elastic and resilient material; wherein said left fin base has said left bearing which is mounted on said left shaft; whereby said left fin can be rotated around said left axis with respect to said left shoe; in addition, said right fin base has said right bearing which is mounted on said right shaft; whereby said right fin can be rotated around said right axis with respect to said right shoe.

6. The swimming device of claim number 5, wherein said left fin comprising a left positioning mechanism which can position and lock said left fin at said left walking position or at said left swimming position; wherein said right fin comprising a right positioning mechanism which can position and lock said right fin at said right walking position or at said right swimming position.

7. The swimming device of claim number 6, wherein said left positioning mechanism comprising a left member, which is attached to said left fin; said left member has a set of left protrusions; wherein said left bearing comprising a set of left walking recesses and a set of left swimming recesses; wherein said left positioning mechanism can lock said left fin at said left walking position by inserting said set of left protrusions into said set of left walking recesses; also, said left positioning mechanism can lock said left fin at said left swimming position by inserting said set of left protrusions into said set of left swimming recesses; said user can switch position of said left fin from said left walking position into said left swimming position by temporarily removing said set of left protrusions from said set of left walking recesses, next rotating said left fin into said left swimming position and then inserting said set of left protrusions into said set of left swimming recesses; said user can switch position of said left fin from said left swimming position into said left walking position by temporarily removing said set of left protrusions from said set of left swimming recesses, next rotating said left fin into said left walking position and then inserting said set of left protrusions into said set of left walking recesses; in addition, said right positioning mechanism comprising a right member, which is attached to said right fin; said right member has a set of right protrusions; wherein said right bearing comprising a set of right walking recesses and a set of right swimming recesses; wherein said right positioning mechanism can lock said right fin at said right walking position by inserting said set of right protrusions into said set of right walking recesses; also, said right positioning mechanism can lock said right fin at said right swimming position by inserting said set of right protrusions into said set of right swimming recesses; said user can switch position of said right fin from said right walking position into said right swimming position by temporarily removing said set of right protrusions from said set of right walking recesses, next rotating said right fin into said right swimming position and then inserting said set of right protrusions into said set of right swimming recesses; said user can switch position of said right fin from said right swimming position into said right walking position by temporarily removing said set of right protrusions from said set of right swimming recesses, next rotating said right fin into said right walking position and then inserting said set of right protrusions into said set of right walking recesses.

8. The swimming device of claim number 7, wherein said left member comprising a left polygonal bar; said left shaft comprising a left polygonal cavity which is centered along said left axis; wherein said left polygonal bar fits into said left polygonal cavity; wherein said left polygonal cavity allows said left polygonal bar to move along said left axis but not to rotate around said left axis; wherein said left polygonal bar has a left inner square cavity which has a left inner square floor with a left round hole; wherein said left inner square cavity contains a left round bar and a left compression spring which is wound around said left round bar; wherein said left round bar has a left square head which fits into said left inner square cavity; said left round bar has a left round bar lower section which passes through said left round hole and is anchored to said left heel; wherein said left compression spring is pre-compressed inside said left inner square cavity between said left square head and said left inner square floor; wherein said left compression spring has a bias which tends to push said left member along said left axis towards said left heel; whereby, said left fin, which is attached to said left member is also being pushed towards said left heel; wherein, left fin is fastened to said left heel; said compression spring bias also tends to push said set of left protrusions into said set of left walking recesses when said left fin is rotated into said left walking position; thereby, locking said left fin in said left walking position since said set of left protrusions are connected to said left member which cannot rotate around said left axis with respect to said left shoe; said compression spring bias also tends to push said set of left protrusions into said set of left swimming recesses when said left fin is rotated into said left swimming position; thereby, locking said left fin in said left swimming position since said set of left protrusions are connected to said left member which cannot rotate around said left axis with respect to said left shoe; when said user wants to switch said left fin from said left walking position into said left swimming position or vice versa, said user has to unlock said left fin by pulling backwards said left member against bias of said left compression spring, rotate said left fin into a new left position and stop pulling said left member such that said left member locks said left fin in said new left position; pulling backwards said left member unlocks said left fin since pulling removes said set of left protrusions either from said set of left walking recesses or from said set of swimming recesses;

wherein said right member comprising a right polygonal bar; said right shaft comprising a right polygonal cavity which is centered along said right axis; wherein, said right polygonal bar fits into said right polygonal cavity; wherein, said right polygonal cavity allows said right polygonal bar to move along said right axis but not to rotate around said right axis; wherein, said right polygonal bar has a right inner square cavity which has a right inner square floor with a right round hole; wherein, said right inner square cavity contains a right round bar and a right compression spring wound around said right round bar; wherein, said right round bar has a right square head which fits into said right inner square cavity; wherein, said right round bar has a right round bar lower section which passes through said right round hole and is anchored to said right heel; wherein, said right compression spring is pre-compressed inside said right inner square cavity between said right square head and said right inner square floor; wherein said right compression spring has a bias which tends to push said right member along said right axis towards said right heel; whereby, said right fin, which is attached to said right member is also being pushed towards said right heel; thereby, left fin is fastened to said left heel; said compression spring bias also tends to push said set of right protrusions into said set of right walking recesses when said right fin is rotated into said right walking position; whereby, locking said right fin in said right walking position since said set of right protrusions are connected to said right member which cannot rotate around said right axis with respect to said right shoe; wherein, said compression spring bias also tends to push said set of right protrusions into said set of right swimming recesses when said right fin is rotated into said right swimming position; thereby, locking said right fin in said right swimming position since said set of right protrusions are connected to said right member which cannot rotate around said right axis with respect to said right shoe; when said user wants to switch said right fin from said right walking position into said right swimming position or vice versa, said user has to unlock said right fin by pulling backwards said right member against bias of said right compression spring, rotate said right fin into a new right position and stop pulling said right member such that said right member locks said right fin in said new right position; wherein, pulling backwards said right member unlocks said right fin since pulling removes said set of right protrusions either from said set of right walking recesses or from said set of swimming recesses.

9. The swimming device of claim number 7, wherein, a left bearing circle is defined as a planar circle centered at said left axis and perpendicular to said left axis vector; wherein said left bearing circle has a diameter which is equal to the diameter of said left bearing; wherein said left member has said set of left protrusions which includes: a left protrusion number 1 and a left protrusion number 2; said left protrusion number 1 and said left protrusion number 2 are positioned on said left bearing circle; wherein, angular spacing between said left protrusion number 1 and said left protrusion number 2 is: 180−2*Angle2 degrees measured in counterclockwise direction; wherein said Angle2 is equal to said left tilt angle; wherein said left protrusion number 1 is situated at Angle2 measured in counterclockwise direction from said left vertical vector; wherein said left protrusion number 2 is situated at: 180−Angle2 degrees measured in counterclockwise direction from said left vertical vector; wherein said set of left walking recesses and said set of left swimming recesses are positioned on said left bearing circle; wherein said set of left walking recesses includes: a left walking recess number 1 which is situated at zero degrees from said left axis of symmetry vector and a left walking recess number 2 situated at: 180−2*Angle2 degrees measured in counterclockwise direction from said left axis of symmetry vector; wherein said set of left swimming recesses includes: a left swimming recess number 1 which is situated at zero degrees measured from said left axis of symmetry vector and a left swimming recess number 3 situated at:

180+2*Angle2 degrees measured in counterclockwise direction from said left axis of symmetry vector;

wherein, at said left walking position said left protrusion number 1 is inserted in said left walking recess number 1 and said left protrusion number 2 is inserted in said left walking recess number 2; wherein at said left swimming position said left protrusion number 1 is inserted in said left swimming recess number 3 and said left protrusion number 2 is inserted in said left swimming recess number 1; wherein, a right bearing circle is defined as said planar circle which is centered at said left axis and perpendicular to said left axis vector; wherein said right bearing circle has a diameter which is equal to the diameter of said right bearing; wherein said right member has said set of right protrusions which includes: a right protrusion number 1 and a right protrusion number 2; said right protrusion number 1 and said right protrusion number 2 are positioned on said right bearing circle; wherein, angular spacing between said right protrusion number 1 and said right protrusion number 2 is: 180−2*Angle2 degrees measured in clockwise direction; wherein said Angle2 is equal to said right tilt angle; wherein said right protrusion number 1 is situated at Angle2 measured in clockwise direction from said right vertical vector; wherein said right protrusion number 2 is situated at: 180−Angle2 degrees measured in clockwise direction from said right vertical vector; wherein said set of right walking recesses and said set of right swimming recesses are positioned on said right bearing circle; wherein said set of right walking recesses includes: a right walking recess number 1 which is situated at zero degrees from said right axis of symmetry vector and a right walking recess number 2, which is situated at: 180−2*Angle2 degrees measured in clockwise direction from said right axis of symmetry vector; wherein said set of right swimming recesses includes: a right swimming recess number 1 which is situated at zero degrees measured from said right axis of symmetry vector and a right swimming recess number 3 which is situated at: 180+2*Angle2 degrees measured in clockwise direction from said right axis of symmetry vector;

wherein, at said right walking position said right protrusion number 1 is inserted in said right walking recess number 1 and said right protrusion number 2 is inserted in said right walking recess number 2; wherein at said right swimming position said right protrusion number 1 is inserted in said right swimming recess number 3 and said right protrusion number 2 is inserted in said right swimming recess number 1.

10. The swimming device of claim number 8, wherein said left shoe is equipped with a left latching mechanism which enables to detach said left fin from said left heel; said left latching mechanism also enables to re-attach said left fin to said left heel; wherein said right shoe is equipped with a right latching mechanism which enables to detach said right fin from said right heel; said right latching mechanism also enables to re-attach said right fin to said right heel.

11. The swimming device of claim number 10, wherein said left latching mechanism comprising: a left latch, a left extension spring, a left anchoring screw and said left round bar; said left latch is a rectangular metal strip with a left central opening having a left opening ramp on the right hand side of said left central opening, a left spring hole at the left end of said left latch and a left latching hole at the right end of said left latch; said left round bar has said left square head and said left round bar lower section with a left notch and a left ending ramp; said left latch is housed in a left tunnel in said left heel of said left shoe; said left latch is anchored at said left spring hole to the right end of said left extension spring which is also housed at said left tunnel; the left end of said left extension spring is anchored to said left heel with said left anchoring screw; said left round bar lower section is being anchored to said left heel when said left opening ramp is inserted into said left notch; whereby, said left latching mechanism anchors and fastens said left fin to said left heel since said compression spring pushes said left member which is attached to said left fin towards said left heel;

said user can detach said left fin from said left heel by pulling rightwards at said left latching hole; pulling rightwards at said left latching hole moves rightwards said left latch which in turn removes said left opening ramp from said left notch thus releasing said left round bar and said left fin from said left heel;

when said user wants to attach said left fin to said left heel, said user pushes said left fin towards said left heel, which in turn pushes said left round bar and advances it towards said left latch; next, said left ending ramp slides on said left opening ramp and causes said left latch to slide rightwards until said round bar is able to pass through said left central opening; when said left latch slides rightwards it stretches said left extension spring; when said left round bar advances more through said left central opening said left notch reaches said left opening ramp and then said left latch springs back leftwards inserting its said left opening ramp into said left notch; whereby, anchoring said round bar to said left heel; thereby, said left fin also is anchored to said left heel because said left fin is connected to said left round bar; said user can detach said left fin from said left heel by pulling rightwards at said left latch which removes said left opening ramp from said left notch; thereby, releasing said left round bar and said left fin from said left heel;

wherein said right latching mechanism comprising: a right latch, a right extension spring, a right anchoring screw and a right round bar; said right latch is a rectangular metal strip with a right central opening having a right opening ramp on the left hand side of said right central opening, a right spring hole at the right end of said right latch and a right latching hole at the left end of said right latch; said right round bar has said right square head and said right round bar lower section with a right notch and a right ending ramp; said right latch is housed in a right tunnel in said right heel of said right shoe; said right latch is anchored at said right spring hole to the left end of said right extension spring which is also housed at said right tunnel; the right end of said right extension spring is anchored to said right heel with said right anchoring screw; said right round bar lower section is anchored to said right heel when said right opening ramp is inserted into said right notch; whereby, said right latching mechanism anchors and fastens said right fin to said right heel since said compression spring pushes said right member which is attached to said right fin towards said right heel; said user can detach said right fin from said right shoe by pulling leftwards at said right latching hole; pulling leftwards at said right latching hole moves to the left said right latch which in turn removes said right opening ramp from said right notch thus releasing said right round bar and said right fin from said right heel;

when said user wants to anchor said right fin to said right heel, said user pushes said right fin towards said right heel, which in turn pushes said right round bar and advances it towards said right latch; next, said right ending ramp slides on said right opening ramp and causes said right latch to slide leftwards until said round bar is able to pass through said right central opening; when said right latch slides leftwards it stretches said right extension spring; when said right round bar advances more through said right central opening said right notch reaches said right opening ramp and then said right latch springs back rightwards inserting its said right opening ramp into said right notch; whereby, anchoring said round bar to said right heel; thereby, said right fin also is anchored to said right heel because it is connected to said right round bar; said user can detach said right fin from said right heel by pulling leftwards at said right latch which moves out said right opening ramp from said right notch; thereby, releasing said right round bar and said right fin from said right heel.

12. The swimming device of claim number 1, wherein said left shoe is equipped with a left latching mechanism which enables to detach said left fin from said left heel; said left latching mechanism also enables to re-attach said left fin to said left heel; wherein said right shoe is equipped with a right latching mechanism which enables to detach said right fin from said right heel; said right latching mechanism also enables to re-attach said right fin to said right heel.

13. The swimming device of claim number 1, wherein said left fin includes a left positioning mechanism which can position and lock said left fin at said left walking position or at said left swimming position; wherein said right fin includes a right positioning mechanism which can position and lock said right fin at said right walking position or at said right swimming position.

14. The swimming device of claim number 13, wherein said left positioning mechanism which is rotatably connected to said left heel is an exact symmetrical, mirror copy of said right positioning mechanism which is rotatably connected to said right heel.

15. The swimming device of claim number 1, wherein said left shoe and said right shoe are made of flexible and resilient material.

16. The swimming device of claim number 9, wherein said left member comprising a left polygonal bar; said left shaft comprising a left polygonal cavity which is centered along said left axis; wherein said left polygonal bar fits into said left polygonal cavity; wherein said left polygonal cavity allows said left polygonal bar to move along said left axis but not to rotate around said left axis; wherein said left polygonal bar has a left inner square cavity which has a left inner square floor with a left round hole; wherein said left inner square cavity contains a left round bar and a left compression spring which is wound around said left round bar; wherein said left round bar has a left square head which fits into said left inner square cavity; said left round bar has a left round bar lower section which passes through said left round hole and is anchored to said left heel; wherein said left compression spring is pre-compressed inside said left inner square cavity between said left square head and said left inner square floor; wherein said left compression spring has a bias which tends to push said left member along said left axis towards said left heel; whereby, said left fin, which is attached to said left member is also being pushed towards said left heel; wherein, left fin is fastened to said left heel; said compression spring bias also tends to push said set of left protrusions into said set of left walking recesses when said left fin is rotated into said left walking position; thereby, locking said left fin in said left walking position since said set of left protrusions are connected to said left member which cannot rotate around said left axis with respect to said left shoe; said compression spring bias also tends to push said set of left protrusions into said set of left swimming recesses when said left fin is rotated into said left swimming position; thereby, locking said left fin in said left swimming position since said set of left protrusions are connected to said left member which cannot rotate around said left axis with respect to said left shoe; when said user wants to switch said left fin from said left walking position into said left swimming position or vice versa, said user has to unlock said left fin by pulling backwards said left member against bias of said left compression spring, rotate said left fin into a new left position and stop pulling said left member such that said left member locks said left fin in said new left position; pulling backwards said left member unlocks said left fin since pulling removes said set of left protrusions either from said set of left walking recesses or from said set of swimming recesses;

wherein said right member comprising a right polygonal bar; said right shaft comprising a right polygonal cavity which is centered along said right axis; wherein, said right polygonal bar fits into said right polygonal cavity; wherein, said right polygonal cavity allows said right polygonal bar to move along said right axis but not to rotate around said right axis; wherein, said right polygonal bar has a right inner square cavity which has a right inner square floor with a right round hole; wherein, said right inner square cavity contains a right round bar and a right compression spring wound around said right round bar; wherein, said right round bar has a right square head which fits into said right inner square cavity; wherein, said right round bar has a right round bar lower section which passes through said right round hole and is anchored to said right heel; wherein, said right compression spring is pre-compressed inside said right inner square cavity between said right square head and said right inner square floor; wherein said right compression spring has a bias which tends to push said right member along said right axis towards said right heel; whereby, said right fin, which is attached to said right member is also being pushed towards said right heel; thereby, left fin is fastened to said left heel; said compression spring bias also tends to push said set of right protrusions into said set of right walking recesses when said right fin is rotated into said right walking position; whereby, locking said right fin in said right walking position since said set of right protrusions are connected to said right member which cannot rotate around said right axis with respect to said right shoe; wherein, said compression spring bias also tends to push said set of right protrusions into said set of right swimming recesses when said right fin is rotated into said right swimming position; thereby, locking said right fin in said right swimming position since said set of right protrusions are connected to said right member which cannot rotate around said right axis with respect to said right shoe; when said user wants to switch said right fin from said right walking position into said right swimming position or vice versa, said user has to unlock said right fin by pulling backwards said right member against bias of said right compression spring, rotate said right fin into a new right position and stop pulling said right member such that said right member locks said right fin in said new right position; wherein, pulling backwards said right member unlocks said right fin since pulling removes said set of right protrusions either from said set of right walking recesses or from said set of swimming recesses.

17. The swimming device of claim number 16, wherein said left shoe is equipped with a left latching mechanism which enables to detach said left fin from said left heel; said left latching mechanism also enables to re-attach said left fin to said left heel; wherein said right shoe is equipped with a right latching mechanism which enables to detach said right fin from said right heel; said right latching mechanism also enables to re-attach said right fin to said right heel.

18. The swimming device of claim number 17, wherein said left latching mechanism comprising: a left latch, a left extension spring, a left anchoring screw and said left round bar; said left latch is a rectangular metal strip with a left central opening having a left opening ramp on the right hand side of said left central opening, a left spring hole at the left end of said left latch and a left latching hole at the right end of said left latch; said left round bar has said left square head and said left round bar lower section with a left notch and a left ending ramp; said left latch is housed in a left tunnel in said left heel of said left shoe; said left latch is anchored at said left spring hole to the right end of said left extension spring which is also housed at said left tunnel; the left end of said left extension spring is anchored to said left heel with said left anchoring screw; said left round bar lower section is being anchored to said left heel when said left opening ramp is inserted into said left notch; whereby, said left latching mechanism anchors and fastens said left fin to said left heel since said compression spring pushes said left member which is attached to said left fin towards said left heel;

said user can detach said left fin from said left heel by pulling rightwards at said left latching hole; pulling rightwards at said left latching hole moves rightwards said left latch which in turn removes said left opening ramp from said left notch thus releasing said left round bar and said left fin from said left heel;

when said user wants to attach said left fin to said left heel, said user pushes said left fin towards said left heel, which in turn pushes said left round bar and advances it towards said left latch; next, said left ending ramp slides on said left opening ramp and causes said left latch to slide rightwards until said round bar is able to pass through said left central opening; when said left latch slides rightwards it stretches said left extension spring; when said left round bar advances more through said left central opening said left notch reaches said left opening ramp and then said left latch springs back leftwards inserting its said left opening ramp into said left notch; whereby, anchoring said round bar to said left heel; thereby, said left fin also is anchored to said left heel because said left fin is connected to said left round bar; said user can detach said left fin from said left heel by pulling rightwards at said left latch which removes said left opening ramp from said left notch; thereby, releasing said left round bar and said left fin from said left heel;

wherein said right latching mechanism comprising: a right latch, a right extension spring, a right anchoring screw and a right round bar; said right latch is a rectangular metal strip with a right central opening having a right opening ramp on the left hand side of said right central opening, a right spring hole at the right end of said right latch and a right latching hole at the left end of said right latch; said right round bar has said right square head and said right round bar lower section with a right notch and a right ending ramp; said right latch is housed in a right tunnel in said right heel of said right shoe; said right latch is anchored at said right spring hole to the left end of said right extension spring which is also housed at said right tunnel; the right end of said right extension spring is anchored to said right heel with said right anchoring screw; said right round bar lower section is anchored to said right heel when said right opening ramp is inserted into said right notch; whereby, said right latching mechanism anchors and fastens said right fin to said right heel since said compression spring pushes said right member which is attached to said right fin towards said right heel; said user can detach said right fin from said right shoe by pulling leftwards at said right latching hole; pulling leftwards at said right latching hole moves to the left said right latch which in turn removes said right opening ramp from said right notch thus releasing said right round bar and said right fin from said right heel;

when said user wants to anchor said right fin to said right heel, said user pushes said right fin towards said right heel, which in turn pushes said right round bar and advances it towards said right latch; next, said right ending ramp slides on said right opening ramp and causes said right latch to slide leftwards until said round bar is able to pass through said right central opening; when said right latch slides leftwards it stretches said right extension spring; when said right round bar advances more through said right central opening said right notch reaches said right opening ramp and then said right latch springs back rightwards inserting its said right opening ramp into said right notch; whereby, anchoring said round bar to said right heel; thereby, said right fin also is anchored to said right heel because it is connected to said right round bar; said user can detach said right fin from said right heel by pulling leftwards at said right latch which moves out said right opening ramp from said right notch; thereby, releasing said right round bar and said right fin from said right heel.

* * * * *